US005865965A

United States Patent [19]

Enda et al.

[11] Patent Number: 5,865,965

[45] Date of Patent: Feb. 2, 1999

[54] APPARATUS FOR ELECTROCHEMICAL DECONTAMINATION OF RADIOACTIVE METALLIC WASTE

[75] Inventors: Masami Enda; Jiro Sakurai; Hitoshi Sakai; Osamu Sasaki, all of Yokohama, Japan

[73] Assignee: Kabushiki Kaisha Toshiba, Kawasaki, Japan

[21] Appl. No.: 786,931

[22] Filed: Jan. 23, 1997

Related U.S. Application Data

[63] Continuation-in-part of Ser. No. 381,513, Feb. 1, 1995, abandoned.

[30] Foreign Application Priority Data

| | | | |
|---|---|---|---|
| Feb. 1, 1994 | [JP] | Japan | 6-010428 |
| Aug. 31, 1994 | [JP] | Japan | 6-206644 |
| Oct. 24, 1996 | [JP] | Japan | 8-282209 |

[51] Int. Cl.[6] ..... C25B 9/00; C25B 11/02; C25B 11/03

[52] U.S. Cl. ..... 204/268; 204/272; 204/284; 204/289; 204/297 R

[58] Field of Search ..... 204/268, 272, 204/289, 284, 297 R

[56] References Cited

U.S. PATENT DOCUMENTS

| | | | |
|---|---|---|---|
| 2,634,222 | 3/1953 | Cox | 204/144 |
| 3,901,786 | 8/1975 | Wheelwright | 204/255 |
| 3,905,885 | 9/1975 | Bengel | 204/129.43 |
| 4,481,089 | 11/1984 | Izumida et al. | 204/129.43 |
| 4,663,085 | 5/1987 | Enda et al. | 252/626 |
| 5,096,550 | 3/1992 | Mayer | 204/129.1 |

FOREIGN PATENT DOCUMENTS

| | | |
|---|---|---|
| 2 565 021 | 11/1985 | France . |
| 60-186799 | 9/1985 | Japan . |
| 3-249600 | 11/1991 | Japan . |
| 5-297192 | 11/1993 | Japan . |

OTHER PUBLICATIONS

Patent Abstracts of Japan, vol. 017, No. 512 (P–1613), Sep. 14, 1993.

Patent Abstracts of Japan, vol. 016, No. 046 (P–1307), Feb. 5, 1992.

Database WPI, Section Ch. Week 9350; Derwent Publications Ltd. (No Date).

*Primary Examiner*—Donald R. Valentine
*Attorney, Agent, or Firm*—Foley & Lardner

[57] ABSTRACT

An insulating shield plate (1) divides a room of an electrolysis bath (2) into an anode chamber (13) and a cathode chamber (14). An anode (5) is disposed in the anode chamber (13), and a cathode (6), metallic waste (7) and heater (4) are disposed in the cathode chamber (14). An electrolyte (3) stored in the electrolysis bath (2) flows in a circulation path from a circulating pump (10) through a circulating line (12) and filter (11) to return the electrolysis bath (2). An exhaust gas processing device 9 is connected to the electrolysis bath (2). When a voltage is supplied to the anode (5) and cathode (6), a surface of the metallic waste (7) is charged in a positive polarity to dissolve a base metal of the metallic waste (7). Further, a cylindrical anode (33) is arranged in an electrolyte (32) in an electrolysis bath (31), and a cylindrical metal (34) as a metallic waste is arranged in the cylindrical anode (33). After a bar-shaped cathode (35) is arranged in the cylindrical metal (34), a DC voltage is supplied to the cylindrical anode (33) and the bar-shaped cathode (35). At this time, the system may be constructed in that oxygen occurs by charging in a positive polarity in an inner surface of the cylindrical metal (34) and the base metal of the cylindrical shape is dissolved.

13 Claims, 29 Drawing Sheets

APPARATUS FOR ELECTROCHEMICAL DECONTAMINATION OF RADIOACTIVE METALLIC WASTE

This application is a continuation-in-part of Ser. No. 08/381,513, filed on Feb. 1, 1995, now abandoned.

BACKGROUND OF THE INVENTION

The present invention relates to an apparatus and method for decontaminating a radioactive metallic waste for the purpose of reducing the radioactivity occurring during operation, outage for inspection and decommission of the nuclear facilities and included in a metallic waste, and more specifically, to an apparatus and method for decontaminating a radioactive metallic waste for the purpose of reducing the radioactivity included in a metallic waste having shapes of a pipe, plate and the like.

Various methods are provided for completely decontaminating the radioactivity included in a radioactive metallic waste and occurring during operation of the nuclear power establishment, at an outage for inspection of the nuclear facilities and at decommissioning the waste. For example, Japanese Patent Laid-open No. 62-46297 and No. 60-186799 disclose an electrolysis decontamination using acid and neutral salt (chloride) solution, which have been developed and utilized.

The electrolysis decontamination is effective with respect to the metallic waste having a comparatively simple shape such as a plate, cylindrical object and the like. A system of the electrolysis decontamination, comprises an anode as a metallic waste, and a cathode arranged in front of a surface to be decontaminated on the metallic waste as the anode, in which a direct voltage is supplied between the metallic waste (anode) and the cathode to polish a base metal on the surface to be decontaminated, thereby decontaminating the radioactivity from the metallic waste.

The electrolysis decontamination mentioned above, however, has the problems as follows:

i) Since the contamination remains behind a connection portion between the metallic waste and the anode because the connection portion is not dissolved, it is necessary to change the manner of holding the anode to decontaminate again so as to complicate the decontamination;

ii) When large scale device and apparatus are decontaminated, since a current value becomes large in proportion to a surface area, it is necessary to provide an anode clamper under the consideration of a contact area. Accordingly, it is also necessary to frequently change the anode clamper to match the shape with the device and apparatus; and iii) When large number of device and apparatus are treated, since it is necessary to change the manner of holding the anode and to change the anode clamper, it is possible for an operator to receive an increased exposure.

A related patent application has been filed at the JPO as a Japanese patent application laid-open No. 5-297192, and No. 6-242295 for decontaminating the radioactivity of the metallic waste by using a bipolar electrolytic with non-contact. The present invention provides higher function and high performance than the previous method.

SUMMARY OF THE INVENTION

In view of the above-mentioned conditions, an object of the present invention is to provide a system and method for a decontamination of radioactive metallic waste, capable of removing radioactivity or decreasing radioactive level of the metallic waste in a short time where it is unnecessary to change a clamp of an electrode and perform an attach of the electrode and taking out of the electrode operation before and after a decontamination.

For achieving the above object, there is a fundamental component of the system and method for a decontamination radioactive metallic waste according to the present invention as follows:.

There is provided a system for decontaminating radioactivity of a metallic waste by performing a bipolar electrolytic with non-contact in an electrolyte in an electrolysis bath with respect to a metallic waste contaminated by radioactive material and by dissolving a base metal by dielectric function so as to remove radioactivity, comprising an electrolysis bath having a predetermined shape and filled up by an electrolyte which has predetermined component, density and temperature for performing the electrolysis;

an anode arranged in the electrolysis bath with a predetermined shape and charged in a positive polarity by a direct current (DC) voltage supplied from a DC power source; and a cathode arranged in the electrolysis bath with a predetermined shape and charged in a negative polarity by the DC voltage supplied from the DC power source:

wherein the predetermined shape of at least any of electrodes of the anode and cathode is formed in correspondence with the predetermined shape of the metallic waste which is set in the electrolysis bath.

Furthermore, there is a system for decontaminating radioactivity of the metallic waste according to the above construction, further comprising an insulating shield plate for dividing a room of the electrolysis bath into an anode chamber and a cathode chamber, and the insulating shield plate which is set in a U-shape along three inner wall surfaces of the electrolysis bath.

There is provided a system for decontaminating radioactivity of the metallic waste according to a construction in the above paragraph, wherein the insulating shield plate is a vessel having an opening at an upper portion thereof;

the anode is arranged at a bottom portion of the electrolysis bath;

the cathode is arranged at a bottom portion of the electrolysis bath;

the metallic waste is supported by an insulation supporting member; and the insulation supporting member is arranged at the bottom of the electrolysis bath having the opening at the upper portion and has a plurality of holes each of which opens in a mesh-shaped for passing through the electrolyte.

There is provided a system for decontaminating radioactivity of the metallic waste according to a construction in the above paragraph, wherein the insulation supporting member is comprised of a basket which has an opening at an upper portion thereof, and stores the metallic waste therein.

There is provided a system for decontaminating radioactivity of the metallic waste according to a construction in the above paragraph, wherein the cathode is comprised of a rectangular pipe or a bar-shaped body, and moves with keeping a constant interval against the metallic waste by a driving mechanism.

There is provided a system for decontaminating radioactivity of the metallic waste according to a construction of the above paragraph, wherein the cathode is comprised of a blind cathode which is formed by connecting a plurality of rectangular pipes or bar-shaped bodies by a flexible cable, the blind cathode which has an insulating elastic body for allowing a water passing therethrough.

There is provided a system for decontaminating radioactivity of the metallic waste according to a construction of the first paragraph, wherein any one of electrodes of two kinds of the anode and the cathode for electrolysis has a cylindrical shape along the outer shape of the metallic waste having a curved portion, and the other of the electrodes is formed in a bar-shaped in correspondence with an inner shape of the metallic waste.

There is provided a system for decontaminating radioactivity of the metallic waste according to a construction of the seventh paragraph, wherein the system comprises an electrolysis bath;

a cylindrical anode which is arranged in the electrolyte in the electrolysis bath;

a cylindrical metallic waste which is arranged in the cylindrical anode;

a bar-shaped cathode which is arranged in the cylindrical metallic waste; and a direct current power source for connecting the cylindrical anode and the bar-shaped cathode.

There is provided a system for decontaminating radioactivity of the metallic waste according to a construction of the seventh paragraph, wherein the system comprises an electrolysis bath;

a cylindrical insulating shield body which is arranged in the electrolyte in the electrolysis bath;

a cylindrical anode which is arranged on an inner wall of the cylindrical insulating shield body;

a cylindrical cathode which is arranged on an outer wall of the cylindrical insulating shield body;

a cylindrical metallic waste which is arranged in the cylindrical anode; and a direct current power source for connecting the cylindrical anode and the bar-shaped cathode.

There is provided a system for decontaminating radioactivity of the metallic waste according to a construction of a ninth paragraph, wherein insulating discs each having an opening are arranged at the upper and lower ends of the cylindrical insulating shield body.

There is provided a system for decontaminating radioactivity of the metallic waste according to the construction on the seventh paragraph, wherein the system comprises an electrolysis bath;

an insulating shield vessel which is arranged in the electrolysis bath and has an opening at the upper portion thereof;

a cathode which is arranged at the bottom of the electrolysis bath;

an anode which is arranged at the bottom of the insulating shield vessel;

a supporting vessel which is arranged in the insulating shield vessel to keep a metallic waste and has an opening at the upper portion thereof: wherein the supporting vessel has a side surface formed of insulating material, and a bottom portion formed of metal material, and the side surface of the supporting vessel has a plurality of holes for allowing the electrolyte therethrough.

There is provided a system for decontaminating radioactivity of the metallic waste according to a construction of an eleventh paragraph, wherein an electric circuit is configured in the manner that the DC voltage is supplied between the anode and the cathode for charging in a negative polarity the metal material at the bottom portion of the supporting vessel facing to the anode, and for charging in a positive polarity an upper surface of the metallic waste kept by the supporting vessel.

Furthermore, a method for decontaminating radioactivity of a metallic waste, at least including a step of performing a bipolar electrolytic with non-contact to the metallic waste contaminated by radioactive material and in an electrolyte in an electrolysis bath, and a step of dissolving a base metal of the metallic waste by dielectric function is provided, thereby eliminating radioactivity; comprising a step of filling up the electrolyte having predetermined component, density and temperature into an electrolysis bath having a predetermined shape for performing the electrolysis;

a step of setting the metallic waste at a predetermined position between a pair of electrodes including an anode and cathode and corresponding to the shape of the metallic waste; and a step of supplying a direct current (DC) voltage from a DC power source to the pair of electrodes to charge in a positive polarity to any one of the pair of electrodes to be the anode and to charge in a negative polarity to the other of the pair of electrodes to be the cathode for performing the electrolyte, thereby dissolving the base metal of the metallic waste.

There is provided a method of decontaminating radioactivity of the metallic waste according to the thirteenth paragraph, further comprising a step of dividing a room in the electrolysis bath into an insulating shield plate into an anode chamber and a cathode chamber;

a step of setting an anode in the anode chamber;

a step of setting a cathode and the metallic waste in the cathode chamber;

a step of supplying the DC voltage to the anode and cathode from the DC power source connected to the anode and cathode, respectively; and a step of charging in a positive polarity to a decontamination surface of the metallic waste facing to the cathode.

There is provided a method of decontaminating radioactivity of the metallic waste according to the fourteenth paragraph, wherein when entire of both surfaces of the metallic waste are contaminated by the radioactivity, a polarity of the DC power source is converted to change the anode to a cathode and the cathode to an anode so as to dissolve the other surface of the metallic waste.

There is provided a method of decontaminating radioactivity of the metallic waste according to the fourteenth paragraph, further comprising a step of using inorganic acid as the electrolyte;

a step of supplying the DC voltage to the pair of electrodes;

a step of reducing and destroying a passive or oxide layer on the predetermined surface of the metallic waste facing to the cathode by charging in a negative polarity to the other surface of the predetermined surface; and a step of stopping a supply of the DC voltage and dissolving the base metal of the metallic waste by using acid force of the inorganic acid.

There is provided a method of decontaminating radioactivity of the metallic waste according to the sixteenth paragraph, wherein a dissolution of the base metal and a reduction and destruction of the passive or oxide layer are repeated by alternatively inverting a polarity of the DC power source.

There is provided a method of decontaminating radioactivity of the metallic waste according to the thirteenth paragraph, comprising a step of setting a cylindrical anode in the electrolyte;

a step of setting a cylindrical metallic waste in the cylindrical anode;

a step of setting a bar-shaped cathode in the cylindrical metallic waste;

a step of supplying the DC voltage from the DC power source to a portion between the cylindrical anode and the bar-shaped cathode; and a step of charging in a positive polarity to an inner surface of the cylindrical metallic waste and in negative polarity to an outer surface of the cylindrical metallic waste, thereby dissolving the inner surface of a base metal of the metallic waste.

There is provided a method of decontaminating radioactivity of the metallic waste according to the eighteenth paragraph, wherein when both of the inner surface and the outer surface of the cylindrical metallic waste are contaminated, a cathode of the DC power source is inverted to an anode, and an anode of the DC power source is inverted to a cathode, thereby dissolving the outer surface of the cylindrical metallic waste.

There is provided a method of decontaminating radioactivity of the metallic waste according to the eighteenth paragraph, wherein a dissolution of the base metal of the inner surface of the cylindrical metallic waste and a reduction and destruction of the oxide layer formed on the inner surface of the cylindrical metallic waste are repeated by alternatively inverting a polarity of the DC power source.

There is provided a method of decontaminating radioactivity of the metallic waste according to the thirteenth paragraph, comprising a step of setting a cylindrical insulating shield body in the electrolyte;

a step of setting a cylindrical anode on an inner wall of the cylindrical insulating shield body, a step of setting a cylindrical cathode on an outer wall of the cylindrical insulating shield body;

a step of setting a cylindrical metallic waste in the cylindrical anode;

a step of connecting the DC power source to the cylindrical anode and the cylindrical cathode;

a step of supplying the DC voltage from the DC power source to the cylindrical anode and cylindrical cathode; and a step of charging in a negative polarity to an outer surface of the cylindrical metallic waste and in a positive polarity to an inner surface of the cylindrical metallic waste, thereby dissolving a base metal at an inner surface of the cylindrical metallic waste.

There is provided a method of decontaminating radioactivity of the metallic waste according to claim the twentyfirst paragraph, wherein when both of the inner surface and the outer surface of the cylindrical metallic waste are contaminated, a cathode of the DC power source is inverted to an anode, and an anode of the DC power source is inverted to a cathode, thereby dissolving the outer surface of the cylindrical metallic waste.

There is provided a method of decontaminating radioactivity of the metallic waste according to the twenty-first paragraph, wherein a dissolution of the base metal of the inner surface of the cylindrical metallic waste and a reduction and destruction of the oxide layer formed on the inner surface of the cylindrical metallic waste are repeated by alternatively inverting a polarity of the DC power source.

DETAILED DESCRIPTION OF THE PREFERRED EMBODIMENTS

There will be described in detail an apparatus and method for decontaminating a radioactivity of a metallic waste according to preferred embodiments of the present invention in reference with the attached drawings.

Figure 1:
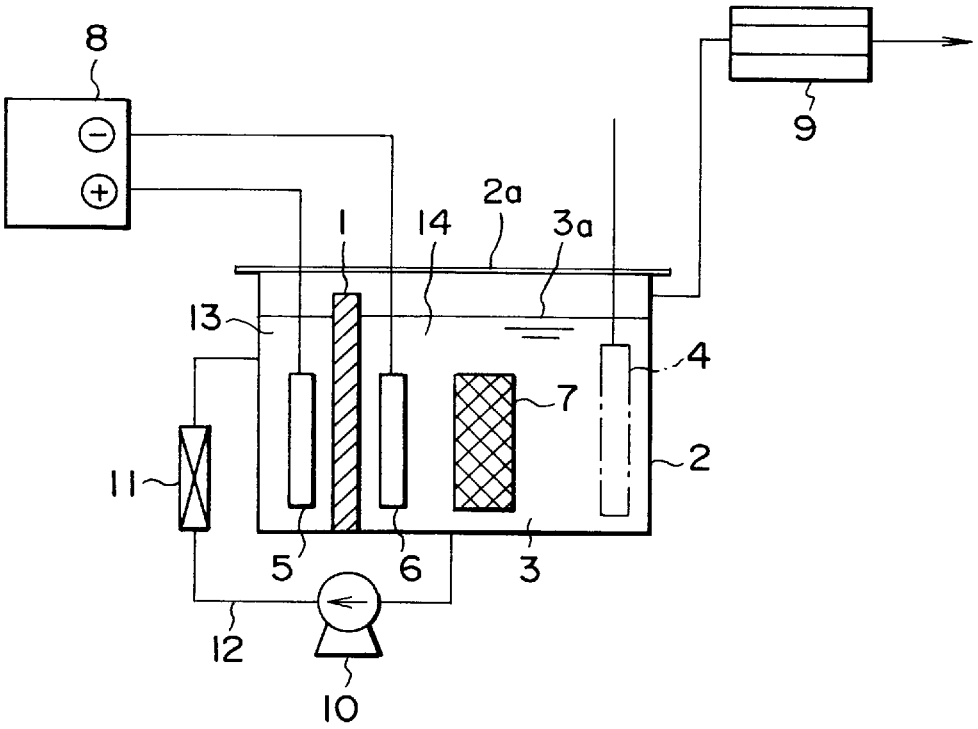
FIG. 1 is a system diagram showing a decontamination system for decontaminating a radioactivity of a metallic waste according to first and fourth embodiments of the present invention.
Figure 2:
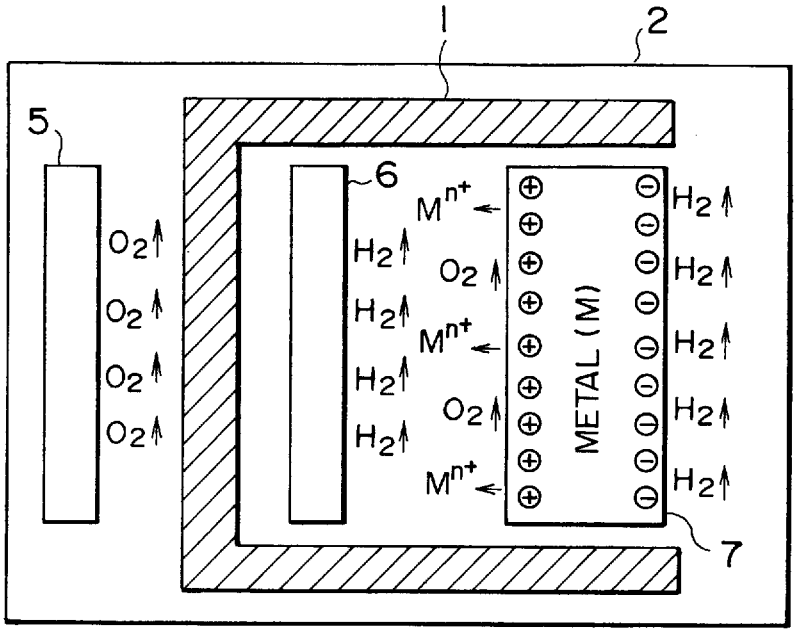
FIG. 2 is a plan view showing an electrolysis bath in the decontamination system according to the first and fourth embodiments shown in FIG. 1.
Figure 3:
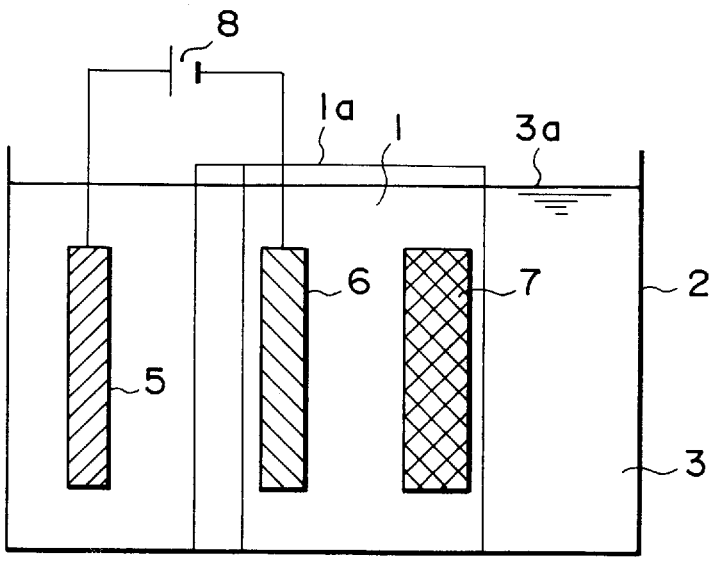
FIG. 3 is a longitudinally sectional view showing the electrolysis bath in the decontamination system according to the first and fourth embodiments shown in FIG. 1.

There is described a system for decontaminating a radioactivity of a metallic waste according to first and fourth embodiments of the present invention in reference with FIGS. 1–3. FIG. 1 is a system diagram showing an example with respect to the first and fourth embodiments. In FIG. 1, numeral 1 denotes an insulating shield plate, and 2 denotes an electrolysis bath which includes a lid 2*a*, an electrolyte 3, and an electrolyte heater 4.

The electrolysis bath 2 is divided into an anode chamber 13 and a cathode chamber 14. The anode chamber 13 has an anode 5 comprised of a deactivate metal, the cathode chamber 14 has a cathode 6 and a metallic waste 7, and the anode 5 and the cathode 6 are connected with a direct current power source 8, respectively.

An exhaust gas treating system 9 is connected to an upper portion of the electrolysis bath 2 to treat the steam and gas generated from the electrolyte 3. The electrolyte 3 circulates through the electrolysis bath 2, a filter 11 and an electrolyte circulation line 12 by a circulating pump 10.

Next, there is described an electrolysis reaction in the method for decontaminating the radioactivity of the metallic waste according to the first embodiment of the present invention by commonly using FIG. 2 showing a plan view of the electrolysis bath 2 and FIG. 3 showing a longitudinally sectional view of the electrolysis bath 2.

The insulating shield plate 1 is formed in a shape of a character "U" as shown in FIG. 2, the cathode 6 is arranged on an inner surface of the insulating plate 1, the anode 5 is arranged on an outer surface of the insulating plate 1, and the anode 5 faces to the cathode 6 with the insulating plate 1 between.

On the other hand, the radioactive metallic waste 7 is grounded in the opposite direction to the anode 5 in the manner of facing to the cathode 6. An ion in the electrolyte 3 moves only in a gap between the insulating shield plate 1 and a side wall of the electrolysis bath 2, and an upper end 1*a* of the insulating shield plate 1 is provided higher than a liquid surface 3*a* of the electrolyte 3 and a lower end 1*b* of the insulating shield plate 1 is connected to a bottom portion of the electrolysis bath 2, in order to prevent the ion to move through upper and lower portions of the electrolysis bath 2. Furthermore, the quality of the material is an insulating material or a metal lined with an insulating material.

In this condition, the circulating pump 10 circulates the electrolyte 3 and the electrolyte heater 4 heats the electrolyte 3 to a predetermined temperature. Then, when the DC power source 8 supplies a DC voltage having a predetermined current density to a portion between the anode 5 and the cathode 6, a reaction represented by the following equations (1)–(3) occurs with respect to the anode 5, cathode 6 and the metallic waste 7 so as to cause a surface (M) of the metallic waste 7 to be charged of a positive electrode by a dielectric function so as to be resolved:

| | | |
|---|---|---|
| (anode) | $H_2O \rightarrow 2H^+ + ½.O_2 \uparrow + 2e^-$ | (1) |
| (cathode) | $H^+ + 2e^- \rightarrow H_2 \uparrow$ | (2) |
| (metallic waste) | $M \rightarrow M^{n+} + ne^-$ | (3) |

The radioactivity fixed to the metallic waste 7 or permeated in the base metal is eliminated from the metallic waste 7 to move into the electrolyte 3 by dissolving the base metal, thereby decontaminating the radioactivity or decreasing the radioactivity level of the metallic waste 7.

When the metallic waste 7 is contaminated over the entire surface, the polarity of the DC power source 8 is inverted to charge an opposite surface to be positive so as to dissolve the base metal. On the other hand, the exhaust gas treating system 9 treats the mist, steam, gas and the like occurring from the electrolyte 3.

Figure 4:
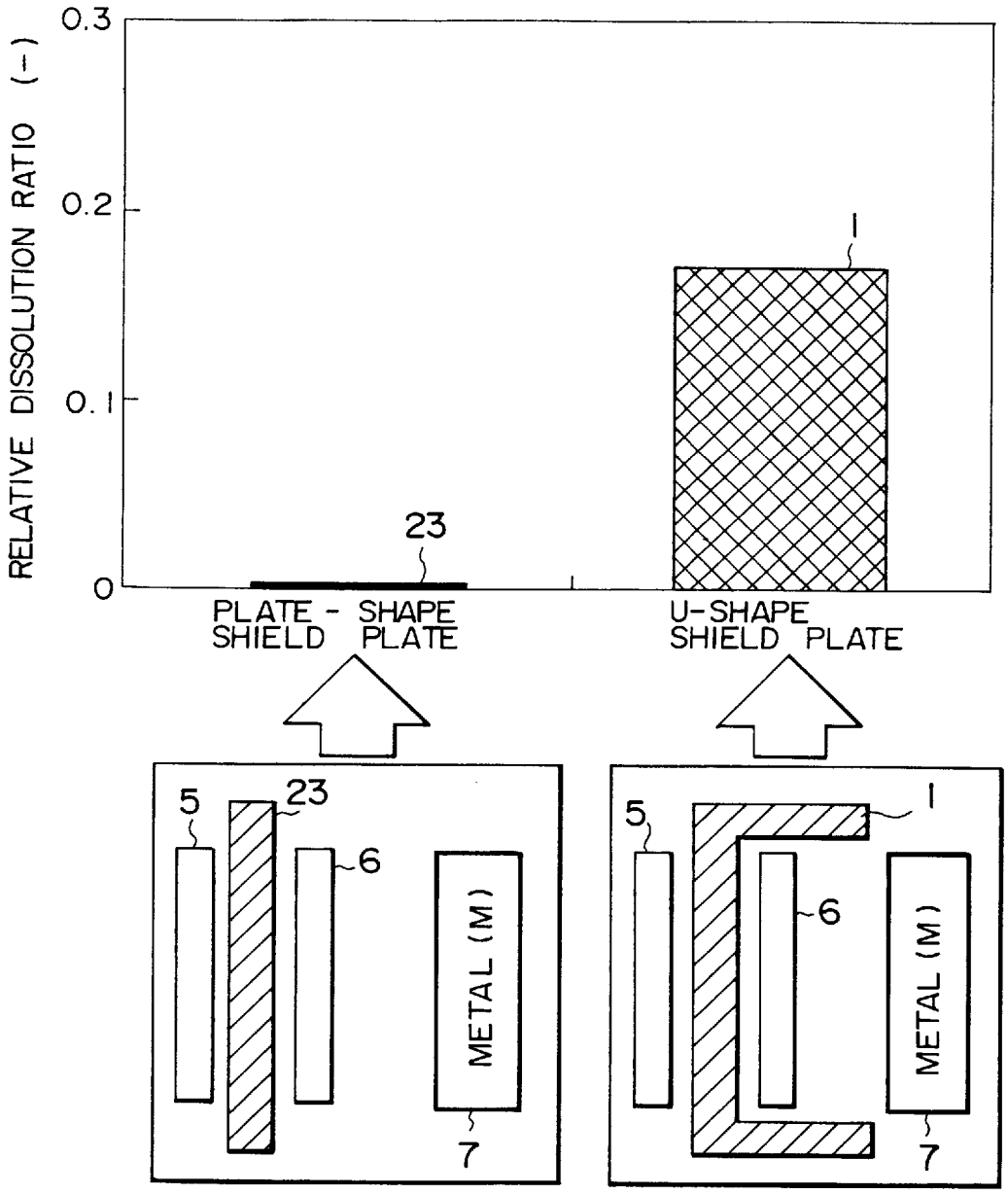
FIG. 4 is an experimental/theoretical view for explaining a system for decontaminating a radioactivity of a metallic waste according to a second embodiment of the present invention.

There is described a system according to a second embodiment of the present invention in accordance with FIG. 4, which shows a relative dissolution ratio (an experimental value/theoretical value) in comparison with stainless steels in any cases when the insulating shield plate is a simple plate-shaped shield plate 23 and when the insulating plate is the U-shape insulating plate 1.

In the second embodiment, sulfuric acid is selected as an acid electrolyte, which has a concentration of 0.5 mol/L and an electrolyte temperature of 80° C., and an electrolysis is performed by supplying a DC voltage having a current density of 0.6 A/cm$^2$ to a portion between the anode and cathode which are comprised of titanium coated by platinum.

As understood from FIG. 4, even though the stainless steel is hardly not dissolved when the insulating shield plate is the simple plate 23, it is possible to obtain a relative dissolution ratio of 0.2 when the plate is the U-shape insulating shield plate 1. A cause of this is that an electrolysis between the anode and cathode is prior to everything because the anode is near the cathode even though the simple plate of the insulating shield plate is provided between the anode and cathode when the insulating shield plate is the simple plate 23.

On the other hand, when the U-shape insulating shield plate 1 is used, an electric field between the cathode and anode is longer shut out by the plate-shaped the stainless steel. Therefore, the leaking of current decreases between the anode and cathode.

Since the distance between the anode and cathode becomes far away by the U-shape insulating shield plate 1, the supplied voltage increases. When a bipolar electrolytic with non-contact dissolves a metal, it is necessary to supply an overpotential larger than an equilibrium potential of a metal dissolving reaction. Accordingly, when a voltage supplied between the anode and cathode becomes large, it is possible to efficiently dissolve the base metal by supplying an overvoltage larger than an equilibrium potential for dissolving a stainless steel.

Furthermore, for causing the distance between the anode 5 and the cathode 6 to be distant and making the distance between the cathode 6 and the metallic waste 7 be near, it is possible to enlarge the size of the electrolysisbath 2. However, in this case, an increase of the liquid amount of the electrolyte 3 causes an occurring amount of a secondary waste (a decontaminated waste fluid) to be also increased. However, since there is provided the U-shape insulating shield plate 1, it is possible to leave a space between the anode 5 and the cathode 6 without the increase of the capacity of the electrolysis bath 2.

As described above, since the second embodiment of the present invention uses the U-shape shield plate 1, it is possible to efficiently dissolve the metallic waste, to decontaminate a radioactivity of the metallic waste, and to decrease the radioactivity level.

Figure 5:
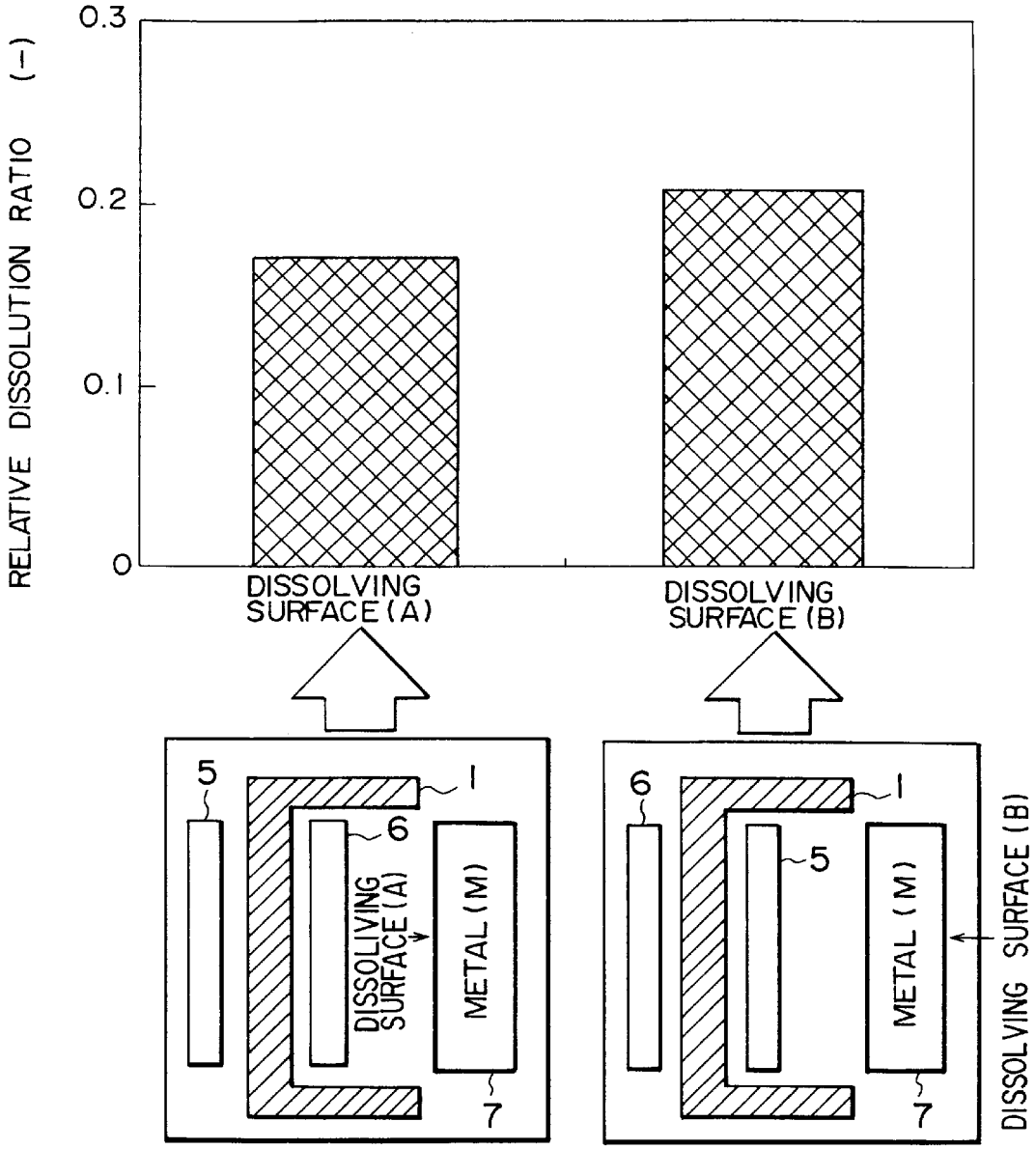
FIG. 5 is an experimental/theoretical view for explaining a system for decontaminating a radioactivity of a metallic waste according to a third embodiment of the present invention.

Next, there is described a system for decontaminating a radioactivity of a metallic waste according to a third embodiment of the present invention in accordance with FIG. 5 showing a relative dissolution ratio (an experimental/theoretical value) when both surfaces of a plate-shaped metal (a stainless steel) are dissolved by inverting a polarity of a direct current power source. In the third embodiment, an electrolysis is performed by supplying a DC voltage to a portion between the anode 5 and the cathode 6 of titanium coated by platinum under the condition that an acid electrolyte is comprised of sulfuric acid having a density of 0.5 mol/L and 80° C. of a temperature.

Even though the stainless steel is not dissolved when the insulating shield plate is formed from the simple plate 23 as shown in FIG. 4, it is possible to obtain a relative dissolution ratio 0.2 when the shield plate is the U-shape shield plate 1.

The reason resides in that the electrolysis between the anode and the cathode is rapid because the cathode is near the anode even through the insulating shield plate when the plate is the simple plate 23.

On the other hand, since an ion must move along the U-shape shield plate and the side wall of the electrolyte bath to reach to the inner cathode when the plate is the U-shape shield plate 1, the distance between the cathode and anode is shorter than the distance between the cathode and the stainless steel, thereby resulting a little current for leaking the portion between the cathode and anode.

Furthermore, the supplied voltage increases because of the large distance between the anode 5 and the cathode 6 through the U-shape shield plate 1. When a metal is dissolved by a bipolar electrolytic with non-contact, the metal surface must be supplied an overpotential larger than an equilibrium potential of the metal dissolving reaction. Accordingly, when the large voltage is supplied to a portion between the anode and the cathode, it is possible to efficiently dissolve the base metal by supplying a potential larger than the equilibrium potential for dissolving the stainless steel.

Even though it is possible to lengthen the distance between the anode 5 and the cathode 6 and to shorten the distance between the cathode 6 and the metallic waste 7 by enlarging the size of the electrolyte bath 2, this case results in an increase of the generated amount of the secondary waste (a decontamination waste liquid) with the decontamination because the liquid amount of the electrolyte 3 increases. However, the U-shape shield plate 1 can enlarge the distance between the anode 5 and the cathode 6 without increasing the capacity of the electrolysis bath 2.

As describe above, since the second embodiment of the present invention uses the U-shape insulating shield plate 1, it is possible to effectively dissolve the metallic waste to decontaminate the radioactivity of the metallic waste, thereby decreasing the radioactivity level.

Next, there is described a third embodiment with reference to FIG. 5 showing a relative dissolution ratio (an experiment/theory value) when both surfaces of the plate-shaped metal (a stainless steel) are dissolved by inverting the polarity of a DC power source. In the same way as the second embodiment shown in FIG. 4, the third embodiment uses sulfuric acid selected as an acid electrolyte, which has a concentration of 0.5 mol/L and an electrolyte temperature of 80° C., and an electrolysis is performed by supplying a DC voltage having a current density of 0.6 A/cm$^2$ to a portion between the anode and cathode which are comprised of titanium coated by platinum.

As clearly understood from the third embodiment, it has been possible to efficiently dissolve both surface (a dissolved surface (A) and a dissolved surface (B)) of the plate-shaped stainless steel by inverting the polarity of the DC power source. A dissolving reaction of the dissolved surface (B) causes one surface of the metallic waste 7 facing the anode 5 to have a negative polarity with an electrostatic charge, and the other surface of the metallic waste 7 to have a positive polarity with an electrostatic charge, thereby dissolving the dissolved surface (B).

As described above, the provision of the U-shape insulating shield plate 1 can efficiently dissolve an entire surface of the metallic waste 7 only by inverting a polarity of the DC power source, thereby decontaminating the radioactivity or reducing the radioactivity level of the metallic waste 7. If the electrolyte of the present invention is comprised of phosphoric acid, nitric acid, sodium sulphate or sodium nitrate without sulfuric acid according to the second embodiment, the same effect can be obtained.

Accordingly, the inversion of a polarity of the DC power source can change from the anode chamber to the cathode chamber and from the cathode chamber to the anode chamber. Any embodiment can be provided to the present invention as far as the insulating shield plate decontaminates the radioactivity of the metallic waste.

Next, there is describe a decontamination system according to a fourth embodiment of the present invention with reference to FIGS. 1 and 2. In the fourth embodiment, sulfuric acid solution is selected as the electrolyte 3, the anode 5 is arranged in the anode chamber 13 which is divided by the insulating shield plate 1, the cathode 6 and metallic waste 7 are arranged in the cathode chamber 14, the electrolyte 3 circulates by the circulation pump 10 to increase a temperature to a predetermined value by the electrolyte heater 4, and the DC voltage is supplied from the DC power source 8 to a portion between the anode 5 and the cathode 6 during a predetermined time interval.

The supply of the DC voltage results in a reaction shown by the equation (1) around the anode 5 to generate oxygen gas, and results in a reaction shown by the equation (2) around cathode 6 to generate hydrogen gas. On the other hand, one surface of the metallic waste 7 facing the cathode 6 has an electrostatic charge of the positive polarity, and the other surface of the waste 7 has a charge of the negative polarity.

Here, even though the waste 7 is easy to be dissolved by sulfuric acid and nitric acid when the metallic waste 7 is a carbon steel, it is difficult to dissolve when an oxide layer and rust are attached on the entire surface of the waste. Since the stainless steel has a passive state layer on its surface, the stainless steel has an excellent anti-corrosion characteristics. However, if the surface of the stainless steel or carbon steel is charged to the negative polarity, a reaction shown by the following equations (4) and (5) happens on the surface so as to reduce and eliminate the passive state layer, oxide layer and rust on the surface.

Metallic waste (negative charged surface)

Passive layer, oxide layer:

$$Fe_3O_4+8H^++2e^-\rightarrow 3Fe^{2+}+4H_2O \quad (4)$$

Reduction of rust:

$$Fe_2O_3+6H^++2e^-\rightarrow 2Fe^{2+}+3H_2O \quad (5)$$

In the above manner, after the passive state layer, oxide layer or rust is reduced and eliminated from the surface of the metallic waste 7, the base metal is exposed to be activated. Under the condition, a stop of the DC voltage supply from the DC power source makes the metallic waste to be dissolved by the oxidizing force of sulfuric acid.

If the anode 5 in the anode chamber 13 changes to a cathode and the cathode 6 in the cathode chamber 14 changes to an anode by converting the polarity of the DC power source 8 so as to cause the surface of the metallic waste 7 facing the converted anode to a negative polarity by an electrostatic charge, the decontamination is performed in the same manner.

Accordingly, radioactivity, which is attached on the metallic waste with the oxide layer or soaks into the base metal, moves into the electrolyte with the oxide layer which is removed from the metallic waste by reducing the oxide layer and dissolving the base metal, thereby decontaminating the radioactivity and decreasing the radioactivity level of the metallic waste.

Figure 6:
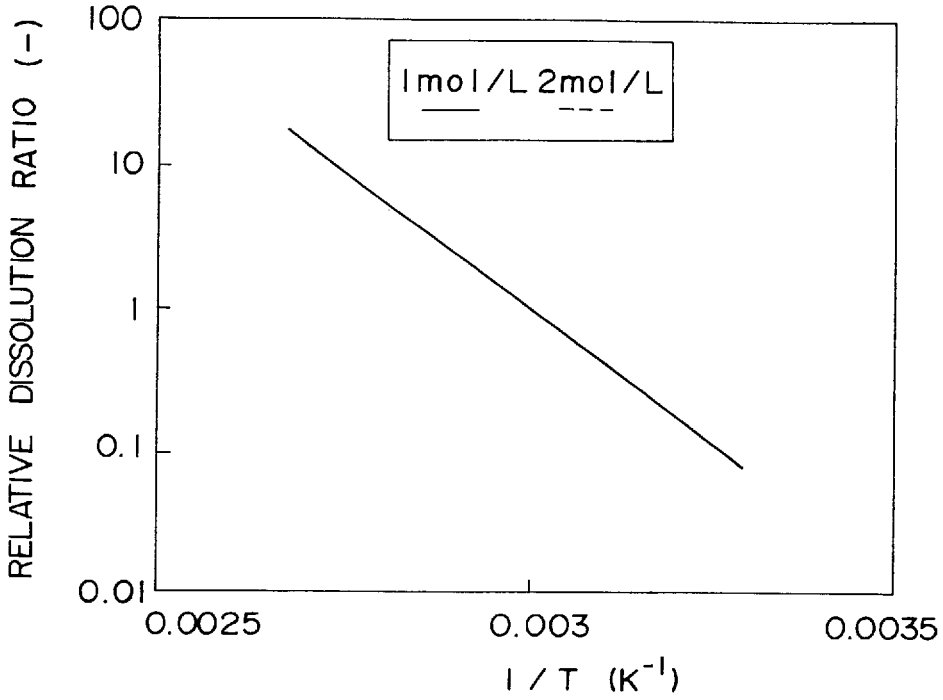
FIG. 6 is a characteristic diagram showing a relationship between a solubility and a reciprocal of an absolute temperature of an electrolyte for explaining a system for decontaminating a radioactivity of a metallic waste according to a fifth embodiment of the present invention.

Next, there is described a decontamination system according to a fifth embodiment for recognizing an effect of the system according to the fourth embodiment, with reference to FIG. 6. In the fifth embodiment, a dissolving experimentation is performed with a stainless steel (SUS 304) by supplying the DC voltage of 5 V for five minutes to a portion between the anode and cathode made of titanium coated by platinum in sulfuric acid having a density of 1 mol/L and 2 mol/L.

In FIG. 6, a longitudinal axis denotes a relative dissolution ratio (a dissolution ratio at each temperature against a dissolution ratio at 60° C.), and a horizontal axis denotes an inverse of an absolute temperature of the electrolyte. A dissolution ratio of a stainless steel has a linear relationship with the inverse of the absolute temperature, and increases by an exponent function with the temperature of the electrolyte.

As described above, the decontamination system according to the fifth embodiment can reduce a radioactivity level or decontaminate the radioactivity of the metallic waste because an electrostatic charge of a negative polarity makes a surface of the metallic waste be easily dissolved by the oxidizing force of sulfuric acid. Accordingly, the system of the present invention can apply to an electrolysis decontamination which has conventionally been difficult to decontaminate for a complex shaped object such as a curved pipe or curved valve. The electrolyte using the electrolyte of the fifth embodiment can change from sulfuric acid to nitric acid or chloric acid so as to obtain the same effect.

Figure 7:
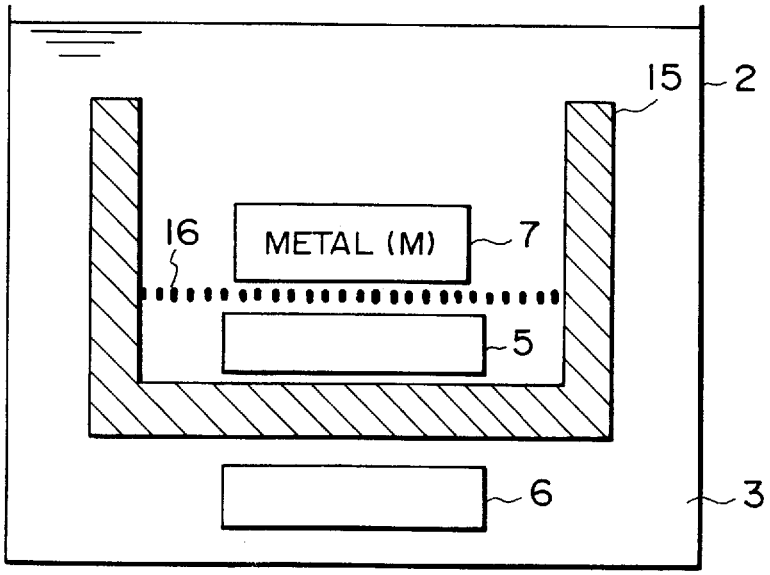
FIG. 7 is a longitudinally sectional view showing a system for decontaminating a radioactivity of a metallic waste according to a sixth embodiment of the present invention.

Next, there is described a decontamination system according to a sixth embodiment of the present invention with reference to FIG. 7 showing a longitudinal cross section of the electrolysis bath 2. In FIG. 7, numeral 15 denotes a shielded vessel having an insulation and an opening portion at an upper end, the anode 5 is arranged at a bottom of the shielded vessel 15, a supporting member 16 having an insulation and a mesh-shaped is arranged at an upper end of the anode 5, and a cathode 6 is arranged at a bottom portion of the electrolysis bath 2 by putting a bottom portion of the shielded vessel 15 therebetween.

The metallic waste 7 is stored in the shielded vessel 15 and supported by the insulation supporting member 16 to which a plurality of through holes are opened in a mesh-shaped for passing therethrough the electrolyte and oxygen gas so as not to contact the metallic waste 7 to the anode 5.

Under the condition, when a DC voltage is supplied to a portion between the anode 5 and cathode 6, a surface opposite to the anode 5 of the metallic waste 7 is charged in electrostatic to a positive polarity because an ion in the electrolyte moves and passes through the holes of the supporting member 16. This charge causes the electrolyte to generate a dissolving reaction shown in FIG. 3, thereby decontaminating the radioactivity and decreasing the radioactive level of the metallic waste.

Accordingly, the shielded vessel 15 having the opening at the upper portion according to the sixth embodiment can increase the decontamination treated amount of the metallic waste per each batch.

Figure 8:
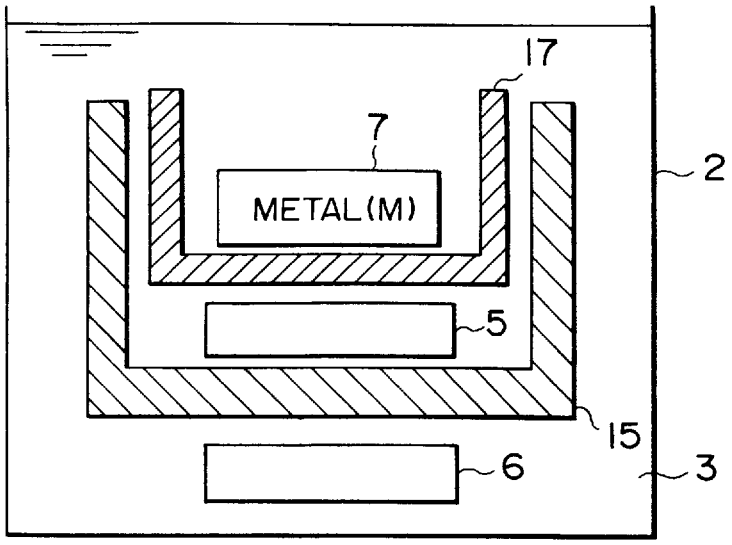
FIG. 8 is a longitudinally sectional view showing a system for decontaminating a radioactivity of a metallic waste according to a seventh embodiment of the present invention.

Next, there is described a decontamination system according to a seventh embodiment with reference to FIG. 8 showing a longitudinal cross section of the electrolysis bath 2. In FIG. 8, numeral 17 is an insulating basket having an opening at an upper portion, in which a metallic waste 7 is stored. The basket 17 is arranged in the insulating shielded vessel having the opening at its upper portion. The anode 5 is arranged at a bottom of the shielded vessel 15, and the cathode 6 is arranged at a bottom of the electrolysis bath 2 in the manner of putting the bottom of the shielded vessel 15 therebetween.

Under this condition, when a DC voltage is supplied to a portion between the anode 5 and cathode 6, a surface opposite to the anode 5 of the metallic waste 7 is charged in electrostatic to a positive polarity because an ion in the electrolyte moves and passes through the holes of the supporting member 16. This charge causes the electrolyte to generate a dissolving reaction shown in FIG. 3, thereby decontaminating the radioactivity and decreasing the radioactive level of the metallic waste.

Accordingly, the insulating basket 17 having the opening at the upper portion according to the seventh embodiment also can increase the decontamination treated amount of the metallic waste 7 per each batch in the same manner as the sixth embodiment. Furthermore, since the insulating basket 17 can be stored and taken out by using the driving mechanism in and from the electrolysis bath 2, it becomes easy to automatically perform mass processing.

When the systems according to the first through third embodiments are combined with the systems according to the fourth through sixth embodiments or the system according to the fourth embodiment, it is possible to alternatively repeat oxidization and reduction on the surface of the metallic waste 7 by inverting the polarity of the DC power source at each predetermined time. By this, it is possible to selectively eliminate an oxide layer and rust by reducing them as a contamination source of the metallic waste 7.

After that, since it is possible to decontaminate and decrease the radioactivity and its level by little dissolving amounts of the base metal when an oxidization dissolves the base metal, it is possible to decrease an amount of the secondary waste in accordance with the decontamination.

Accordingly, since the seventh embodiment has an effect for the metallic waste made of the carbon steel which has thick oxide layer and rust including a radioactivity and strongly fixed on its surface, a repeated processing of oxidization and reduction can remove the radioactivity in a short time, thereby decreasing the radioactive level.

Figure 9:
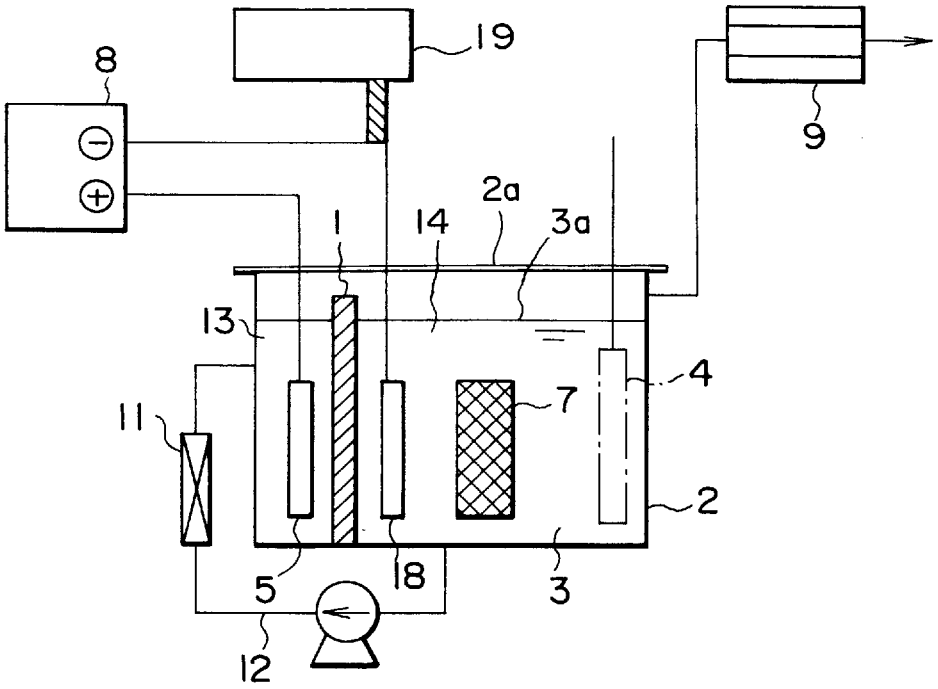
FIG. 9 is a system diagram showing a system for decontaminating a radioactivity of a metallic waste according to an eighth embodiment of the present invention.
Figure 10:
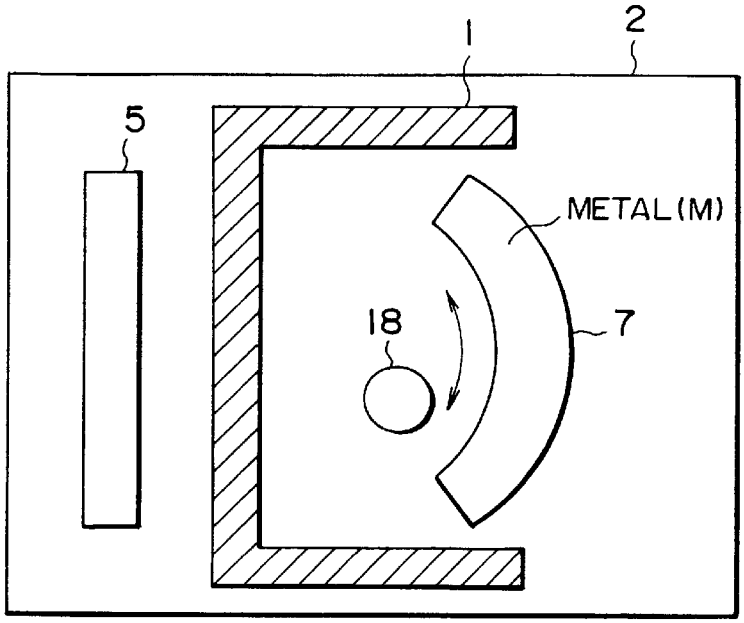
FIG. 10 is a plan view showing an arrangement relationship between a bar-shaped cathode in an electrolysis bath and a curved metallic waste shown in FIG. 9.

There is described a decontamination system according to an eighth embodiment of the present invention with reference to FIGS. 9 and 10. FIG. 9 is a system diagram showing an example of a system for explaining the eight embodiment, in which numeral 1 denotes the insulating shield plate, 2 is the electrolysis bath including the electrolyte 3 and storing the electrolyte heater 4.

The electrolysis bath 2 is divided into the anode chamber 13 and cathode chamber 14 by the insulating shield plate 1. The anode 5 made of inert metal is stored in the anode chamber 13, and the metallic waste 7 and the cathode 18 are stored in the cathode chamber 14. The cathode 18 has a bar shape or a rectangular pipe shape which is made of the inert metal, and the anode 5 and the cathode 18 are respectively connected to the DC power source 8.

Furthermore, an exhaust gas processing system 9 is connected to the upper portion of the electrolysis bath 2 for processing steam and gas occurring from the electrolyte 3. The electrolyte 3 circulates in the electrolysis bath 2, filter 11 and electrolyte circulation line 12 by the circulation pump 10.

There is described an operation for decontaminating the radioactieity of the metallic waste according to the eighth embodiment of the present invention with reference to FIG. 10 showing a plan view of the electrolysis bath 2 shown in FIG. 9.

The insulating shield plate 1 has the U-shape having an inner surface to which the bar-shaped or rectangular-shaped cathode 18 is arranged and faced, and an outer surface to which the anode 5 is arranged and faced. The cathode 18 and anode 5 are arranged to face each other by putting the insulating waste 1 therebetween.

On the other hand, the metallic waste 7 is grounded in the direction opposite to the insulating shield plate 1 for facing the cathode 18. An ion in the electrolyte 3 moves in only a gap between the insulating shield plate 1 and the side wall of the electrolysis bath 2, and the upper portion of the shield plate 1 is higher than a liquid surface 3*a* of the electrolyte 3 and the lower portion of the shield plate 1 is connected to the bottom portion of the electrolysis bath 2 in order to prevent an ion from moving through the upper and lower portions of the electrolysis bath 2.

Furthermore, the material of the electrolysis bath 2 is the insulating material or the metal coated by an insulating material. In this condition, the circulation pump 10 circulates the electrolyte 3 to increase the temperature to a predetermined value by the electrolyte heater 4 so as to supply a DC voltage having a predetermined current density from the DC power source 8 to a portion between the anode 5 and cathode 18.

When the driving mechanism 19 moves the cathode 18 by keeping a predetermined interval against the surface of the metallic waste 7, the surface of the metallic waste (M) against the cathode 18 is dissolved by a reaction shown in the equation (3) on the basis of the dielectric function.

When the decontamination is performed with respect to the curved plate, if the plate-shaped cathode is used, since the distance between the cathode and the surface of the metallic waste becomes partially different from each other, it is possible to leave a partial contamination. In the eighth embodiment, since the bar-shaped or pipe-shaped cathode 18 is used to decontaminate the radioactivity by moving by keeping the predetermined gap against the metallic waste surface by the driving mechanism 19, it is possible to uniformly dissolve the metal surface, thereby equally decontaminating the radioactivity after preventing the partial remaining contamination.

When the metallic waste before decontaminated has a partial contamination, the dissolution of the entire contaminated surface increases an occurring amount of the secondary waste. However, since the system according to the eighth embodiment can decontaminate by moving the bar-shaped or pipe-shaped cathode near to the contaminated portion of the metallic waste, it is possible to largely decrease the occurring amount of the secondary waste in comparison to the dissolution of the entire metal surface.

Accordingly, when the decontamination is performed by moving the bar-shaped or pipe-shaped cathode by the driving mechanism, the metallic waste having the curved plate can be even decontaminated for its surface. Furthermore, since the partial contamination can be contaminated within this region, it is possible to improve an application for the shape of the metallic waste, thereby largely decreasing the occurring amount of the secondary waste with the decontamination.

Figure 11:
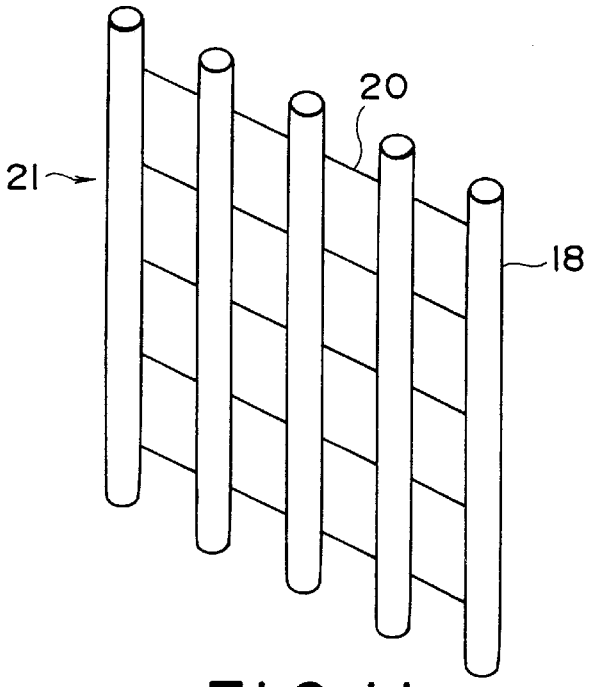
FIG. 11 is a perspective view showing a first blind-shaped cathode set in an electrolysis bath shown in FIG. 9.
Figure 12:
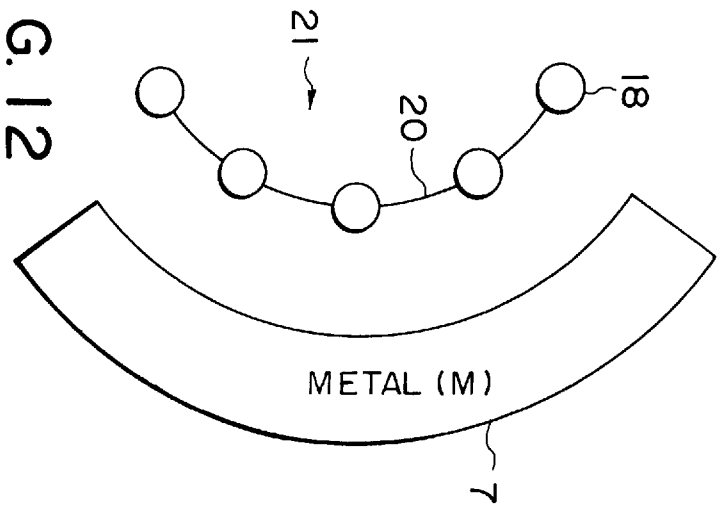
FIG. 12 is a front view showing a set condition of the first blind-shaped cathode in the curved metallic waste shown in FIG. 11.
Figure 13:
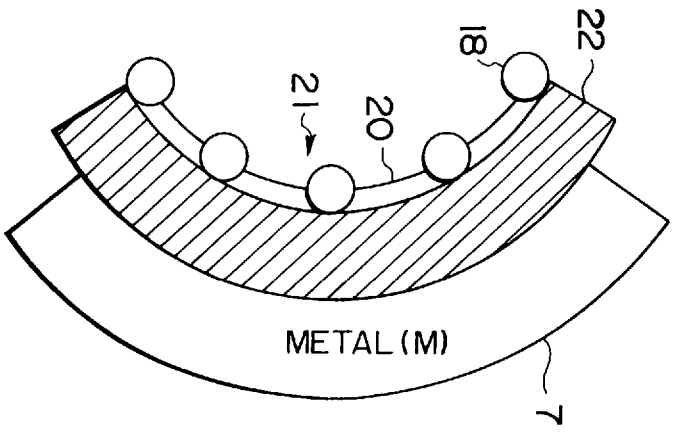
FIG. 13 is a front view showing a set condition of a second blind-shaped cathode in the curved metallic waste shown in FIG. 9.

Next, there are described two modified examples of the eighth embodiment with respect to the method and system for decontaminating the radioactivity with reference to FIGS. 11 through 13. FIG. 11 shows a first example of the blind-shaped cathode 21 in which a plurality of bar-shaped cathodes 18 are arranged in a blind shape by means of a connection by a flexible cable 20, thereby freely bending a portion of the flexible cable 20.

FIG. 12 shows a case in which the blind-shaped cathode 21 shown in FIG. 11 is used for the curved metallic waste 7. Since the blind shape cathode 21 can be bent at a portion of the flexible cable 20, the cathode 21 changes to the curved shape along the shape of the metallic waste 7, thereby uniformly decontaminating the radioactivity on the metal surface by keeping a predetermined interval against the surface of the metallic waste.

FIG. 13 shows a second example in which an insulating elastic body 22 allowing a water passing through is attached with the blind shape cathode 21. The insulating elastic body 22 can prevent the blind shape cathode 21 and metallic waste 7 from a contact and can keep the distance between the metallic waste 7 and blind shape cathode 21 to a predetermined degree, thereby uniformly decontaminating the radioactivity on the surface of the metallic waste 7. The insulating elastic body 22 can be utilized by a material such as a rubber having a plurality of holes or a sponge.

In the above-mentioned system or method for decontaminating a radioactivity of the metallic waste according to the embodiments of the present invention, since the electrolysis occurs on the wall surface of the electrolysis bath by a dielectric function when the material of the vessel is metal, it is impossible to efficiently charge with electrostatic to a positive or negative polarity on the surface of the metallic waste.

Accordingly, the electrolysis bath, insulating shield plate, shield vessel, supporting member in the shield vessel and basket are made of the simple of the insulating materials having a chemical-proof material such as a fluorocarbon polymer, fiber reinforced plastic (FRP) and the like, or metal lined by the insulating member. Furthermore, the shape of the electrolysis bath, shield vessel and basket are not limited in the rectangular shape and may be applicable to cylindrical shape.

Furthermore, it is possible to utilize electrodes which are made of copper coated by titanium further coated by platinum, simple platinum electrode, metal except titanium coated by platinum, and lead compound electrode, in addition to titanium coated by platinum as a material of the electrode used in the above embodiment.

Figure 14:
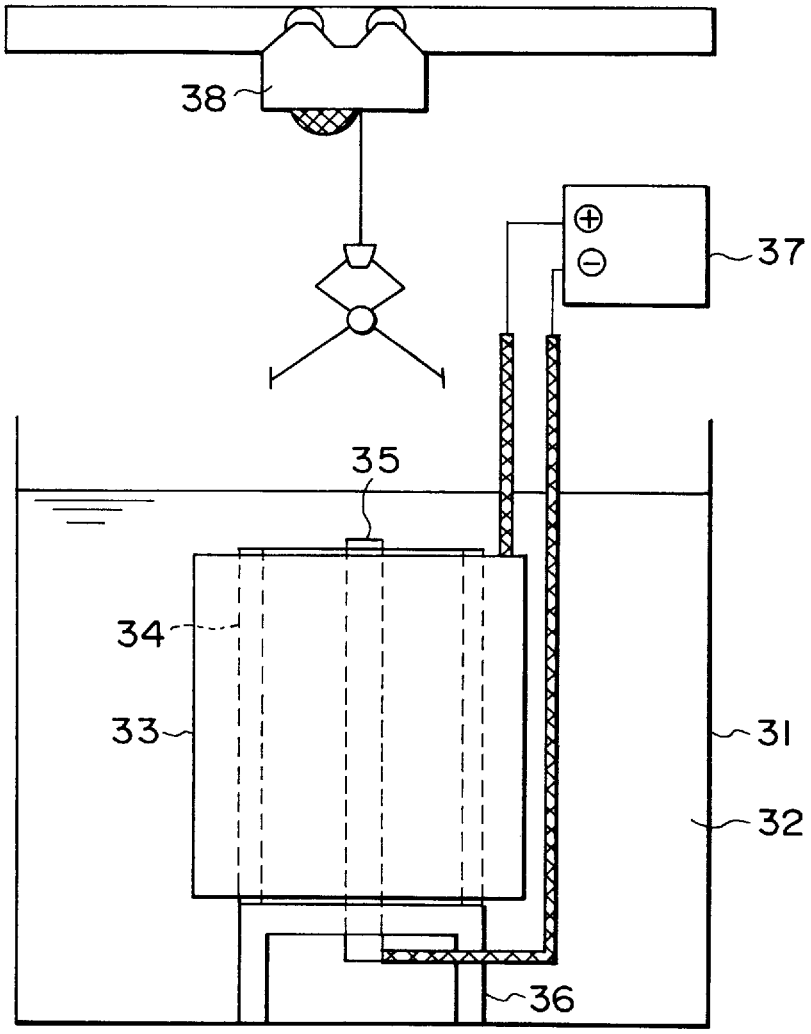
FIG. 14 is a system diagram showing a schematic constitution of a system for decontaminating a radioactivity of a metallic waste according to ninth and thirteenth embodiment of the present invention.
Figure 15A:
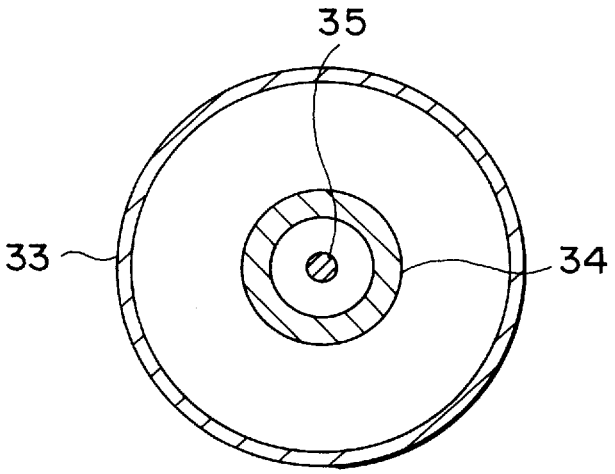
FIGS. 15A and 15B are a cross sectional view and a longitudinally sectional view respectively and schematically showing an important portion of an electrolysis bath shown in FIG. 14.
Figure 15B:
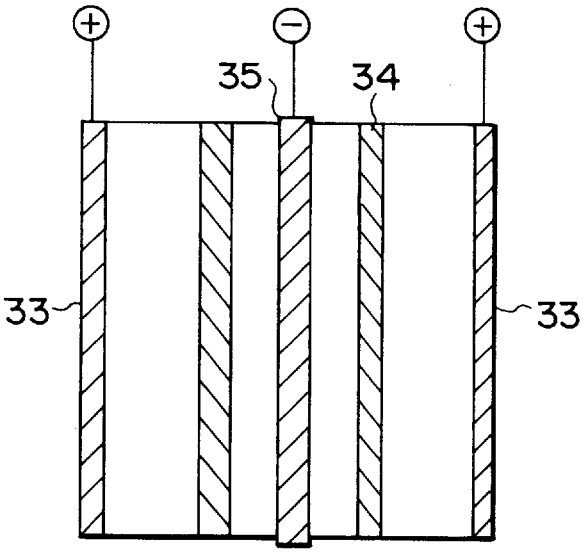
Figure 16:
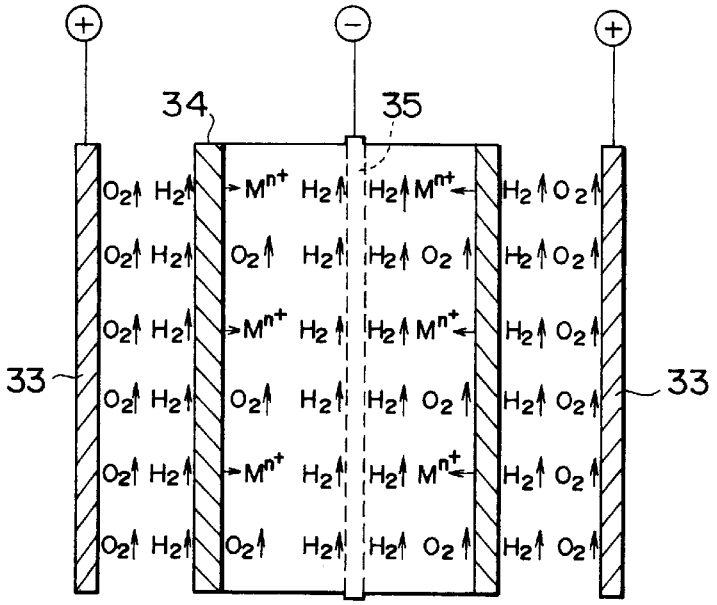
FIG. 16 is a model view for explaining an electrolysis reaction shown in FIG. 15B.

There is described a system for decontaminating a radioactivity of the metallic waste according to a ninth embodiment of the present invention with reference to FIGS. 14–16. FIG. 14 is a longitudinal sectional view showing an example of an electrolysis bath for explaining the system according to the ninth embodiment. In the figure, numeral 31 denotes an electrolysis bath, in which an electrolyte 32 is filled up. There are provided in the electrolyte 32 a cylindrical anode 33, a cylindrical metal 34 as a radioactive metallic waste for an object and enclosed by the cylindrical anode 33, and a bar-shaped cathode 5 in the cylindrical metal 34.

The cylindrical metal 34 is fixed on a platform 36, and the cylindrical anode 33 and the bar-shaped cathode 35 are connected to a direct current power source 37. A handling mechanism 38 is arranged at the upper portion of the electrolysis bath 31 for storing and taking the cylindrical metal 34 in and out the vessel 31.

There is described in detail a positional relationship between the cylindrical anode 33, cylindrical metal 34 and bar-shaped cathode 35 with reference to FIGS. 15A and 15B, in which FIG. 15A is a plan view of the system and FIG. 15B is a longitudinal sectional view of the system. The cylindrical metal 34 is arranged at the center of the cylindrical anode 33, the bar-shaped cathode 35 is arranged at the center of the cylindrical metal 34, and the DC power source 37 is connected to the cylindrical anode 33 and the bar-shaped cathode 35, respectively.

Under this condition, when a DC voltage is supplied from the DC power source 37 to a portion between the cylindrical anode 33 and the bar-shaped cathode 35, a reaction shown in FIG. 16 occurs on the surface of the cylindrical anode 33 and between an inner surface of the cylindrical metal 34 and an outer surface of the bar-shaped cathode 35. The followings are principle of the above reaction:

| | | |
|---|---|---|
| (anode) | $H_2O \rightarrow 2H^+ + ½.O_2 \uparrow + 2e^-$ | (1') |
| (cathode) | $H^+ + 2e^- \rightarrow H_2 \uparrow$ | (2') |
| (outer of metal) | $H^+ + 2e^- \rightarrow H_2 \uparrow$ | (6) |
| (inner of metal) | $M \rightarrow M^{n+} + ne^-$ | (3') |

Since the outer surface of the cylindrical metal 34 faces with the cylindrical anode 33, the outer of the metal 34 is charged in a negative polarity by the dielectric function. Since the inner surface of the cylindrical metal 34 faces with the bar-shaped cathode 35, the inner surface is charged in a positive polarity, thereby dissolving the inner surface of the base metal.

By this, the dissolution of the base metal decontaminates the radioactivity which is fixed on the inner surface of the cylindrical metal 34 or soaked into the base metal from the metal 34 to move into the electrolyte 32, thereby decontaminating the radioactivity or decreasing the radioactivity level of the cylindrical metal 34.

Figure 17:
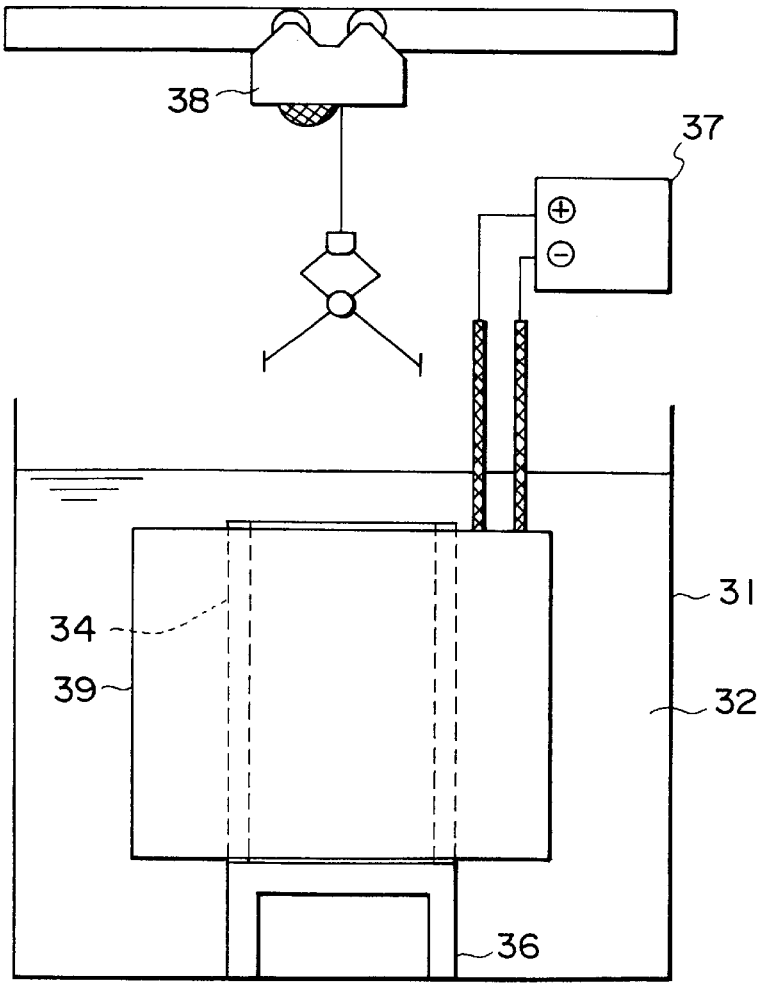
FIG. 17 is a system view showing a schematical constitution of a system for decontaminating a radioactivity of a metallic waste according to a tenth embodiment of the present invention.
Figure 18A:
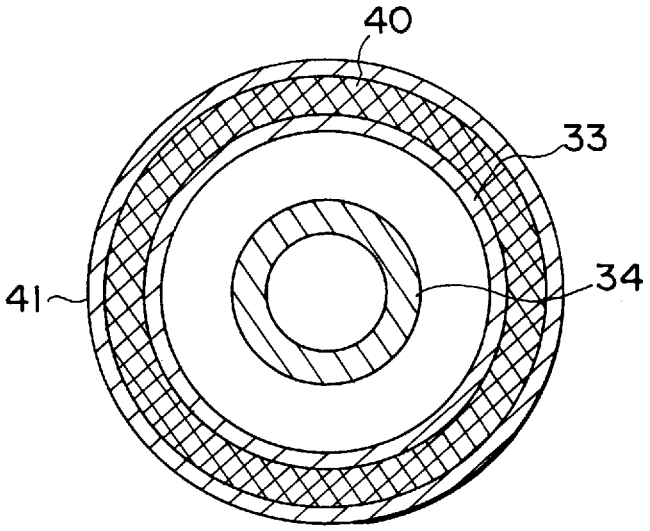
FIGS. 18A and 18B are a cross sectional view and a longitudinally sectional view respectively and schematically showing an important portion of an electrolysis bath shown in FIG. 17.
Figure 18B:
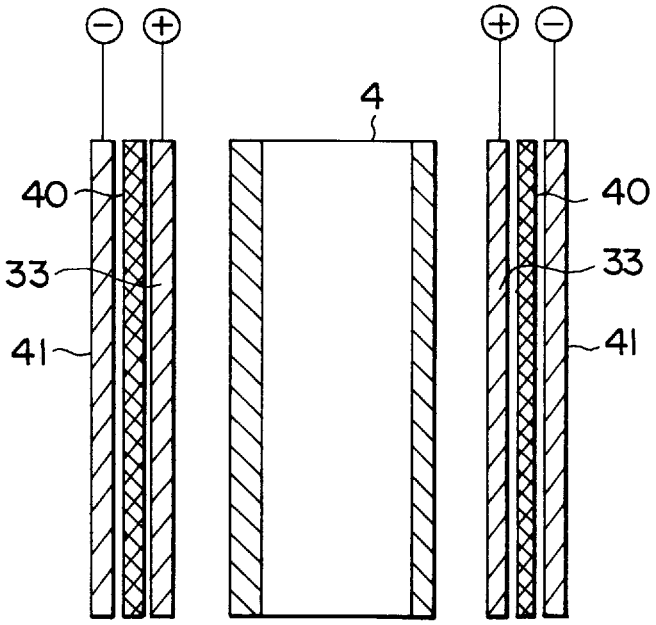
Figure 19:
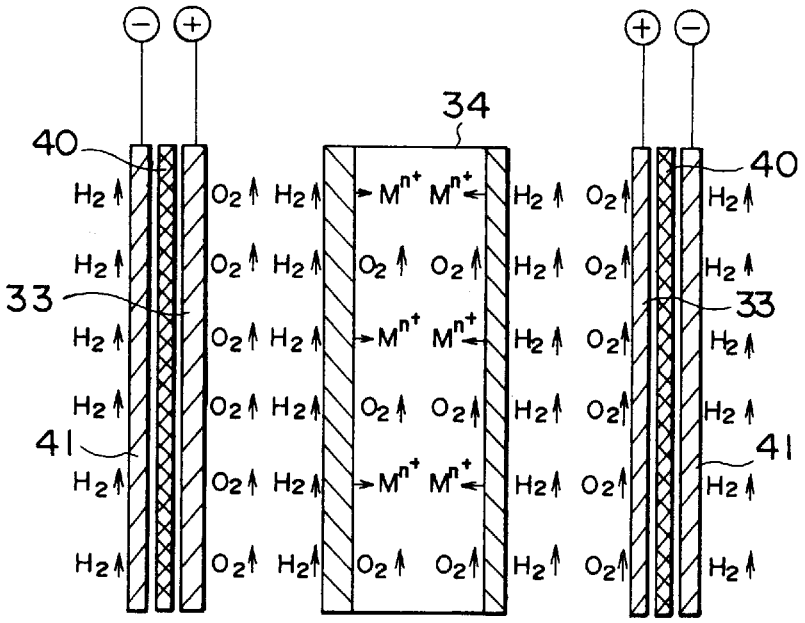
FIG. 19 is a model view for explaining an electrolysis reaction shown in FIG. 18B.

There is described a decontamination system for a radioactive metallic waste according to a tenth embodiment of the present invention with reference to FIGS. 17–19. FIG. 17 is a longitudinal sectional view of an example of an electrolysis bath in the system for explaining the tenth embodiment, in which a numeral 31 denotes an electrolysis bath into which an electrolyte 32 is filled.

There are provided in the electrolyte 32 a cylindrical electrode clamper 39 and the cylindrical metal 34 in the clamper 39. The metal 34 is fixed to the platform 36, and the cylindrical electrode clamper 39 is connected to the DC power source 37. Furthermore, the handling mechanism 38 is set over the electrolysis bath 31 in order to insert and take the cylindrical metal 34 into and out of the bath 31.

There is described in detail the cylindrical electrode clamper 39 with reference to FIGS. 18A and 18B, in which FIG. 18A is a plan view and FIG. 18B is a longitudinal section view. The cylindrical electrode clamper 39 is provided for holding the cylindrical anode 33 to the inner wall of a cylindrical insulating shield body 40 and the cylindrical cathode 41 to the outer wall of the cylindrical insulating shield body 41. The cylindrical metal 34 is set in the cylindrical anode 33, and the DC power source 37 is connected to the cylindrical anode 33 and the cylindrical cathode 41, respectively.

Under this condition, when the DC voltage having a predetermined current density is supplied to the cylindrical anode 33 and the cylindrical cathode 41, respectively, a reaction shown in FIG. 19 occurs at the surfaces of the cylindrical anode 33 and cylindrical cathode 41 and at the inner and outer surfaces of the cylindrical metal 34. The reaction has a principle represented by the equations (1'), (2'), (6) and (3'). The bar-shaped cathode 41 represented by the equation (2') can be replaced by the cylindrical cathode.

Since the outer surface of the cylindrical metal 34 faces the cylindrical anode 33, the outer surface is charged by the dielectric function to the negative polarity, and the inner surface of the cylindrical metal 34 is divided in the polarity to be charged in the positive polarity, thereby dissolving the inner surface of the base metal.

By this, a dissolution of the base metal decontaminates a radioactivity which is fixed on the inner surface of the cylindrical metal 34 or soaked into the base metal from the metal 34 to move into the electrolyte 32, thereby decontaminating the radioactivity or decreasing the radioactivity level of the cylindrical metal 34.

Figure 20:
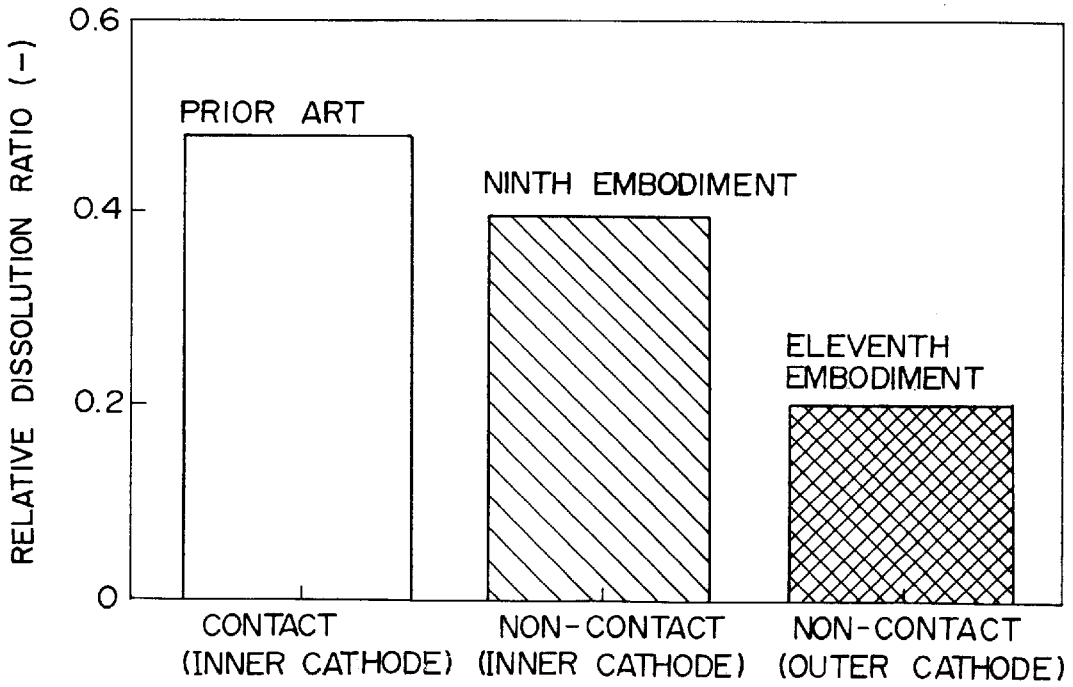
FIG. 20 is a bar graph showing both dissolution ratio of systems respectively according to ninth and eleventh embodiments of the present invention under a comparison with the prior art.

Next, there is described a decontamination system according to an eleventh embodiment of the present invention with reference to FIG. 20. FIG. 20 shows dissolution results of the inner surface of the cylindrical metal 34 formed of the stainless steel by the conventional contact electrolysis (an insert cathode), an insert cathode of the ninth embodiment, and an insert cathode of the tenth embodiment, by using a relative dissolution ratio (experiment/theory values). The theory value can be obtained by Faraday's law.

In the eleventh embodiment, phosphoric acid is selected as the electrolyte, in which the density of phosphoric acid is 40%, a temperature of the electrolyte is 60° C., and a DC voltage having a current density of 0.6 A/cm$^2$ is supplied to a portion between the anode and cathode formed of titanium coated by platinum so as to perform an electrolysis.

As clearly understood from the figures, even though a relative dissolution ratio of this embodiment is slower than that of the conventional contact electrolysis, since the inner surface of the cylindrical metal can be dissolved in the electrolysis method of the present invention, it is possible to decontaminate the radioactivity or decrease the radioactive level of the metallic waste.

As described above, since the ninth embodiment of the present invention can dissolve the inner surface of the curved metal without a connection between the cylindrical metal and the anode, it is possible to improve the work efficiency and to decrease an exposure amount for an operator. Furthermore, since the tenth embodiment of the present invention can dissolve the inner surface of the curved metal without an insertion of the cathode into the cylindrical metal, it is possible to easily insert and take the metal into and out of the electrolysis bath 31, to easily automate the system using the handling mechanism, and to further decrease the exposure amount for an operator.

Figure 21:
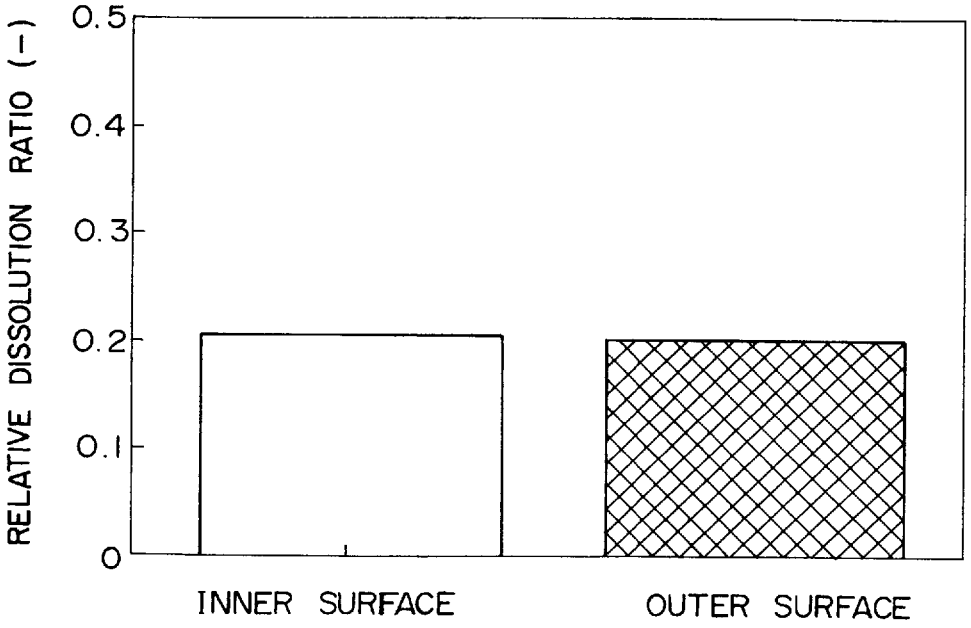
FIG. 21 is a bar graph showing a dissolution ratio on surfaces in comparison with an inner and outer in a system for decontaminating a radioactivity of a metallic waste according to a twelfth embodiment of the present invention.

Next, there is provided a system for decontaminating a radioactivity according to a twelfth embodiment of the present invention with reference to FIG. 21. FIG. 21 shows a relative dissolution ratio (experiment/theory values) as a dissolved result of the inner and outer surfaces of the cylindrical metal 34 formed of a stainless steel in the twelfth embodiment in which a polarity of DC current power source in the tenth embodiment is inverted. In the twelfth embodiment, the density of phosphoric acid is 40%, the temperature of the electrolyte is 60° C., and the current density is 0.6 A/cm$^2$, thereby performing an electrolysis by supplying a DC voltage to a portion between the anode and the cathode which are formed of titanium coated by platinum.

As understood from the twelfth embodiment, it is possible to dissolve the inner and outer surfaces of the cylindrical metal at substantially the same dissolution ratio by inverting a polarity of the DC power source. As described above, since only inversion of a polarity of the DC power source can dissolve the inner and outer surfaces of the cylindrical metal, it is possible to decontaminate a radioactivity and decrease a radioactive level of the cylindrical metal.

Next, there is described a decontamination system according to a thirteenth embodiment of the present invention with reference to FIGS. 14–15B. When the cylindrical metal 34 is a carbon steel, an oxide layer and rust are thickly and firmly formed on the surface of the base metal, and the oxide layer is hard to be dissolved by a simple anode electrolysis. Since takes radioactivity is almost included in the oxide layer, it takes a long time to decontaminate the radioactivity from the cylindrical metal 34.

It is effective that there is a method of alternatively inverting a polarity of the DC power source 37 for decontaminating in a short time the radioactivity of the cylindrical metal 34 of the carbon steel. A charge in the negative polarity to the inner surface (contaminated surface) of the cylindrical metal 34 of the carbon steel causes a reaction on the inner surface to occur so as to reduce the oxide layer and rust.

(Charged surface of negative polarity)

Reduction of oxide layer and rust $$Fe_3O_4+8H^++2e^-\rightarrow 3Fe^{2+}+4H_2O \quad (4)$$

$$Fe_2O_3+6H^++2e^-\rightarrow 2Fe^{2+}+3H_2O \quad (5)$$

In this manner, the oxide layer and rust are reduced and eliminated from the contaminated surface of the cylindrical metal 34, and at the same time the radioactivity in the oxide layer is decontaminated. Furthermore, since the polarity of the DC power source 37 is alternatively converted, the contaminated surface is also charged to the positive polarity so as to dissolve the base metal exposing after the oxide layer is removed, and to remove a contamination soaked into the base metal.

Accordingly, the radioactivity attached on or soaked into the base metal with the oxide layer of the cylindrical metal 34, can be decontaminated with little dissolution amount from the cylindrical metal 34 by reducing the oxide layer and dissolving the base metal to move into the electrolyte 32, thereby decontaminating the radioactivity and decreasing the radioactive level of the cylindrical metal 34, so as to decrease occurring amount of a secondary waste with the decontamination.

Figure 22A:
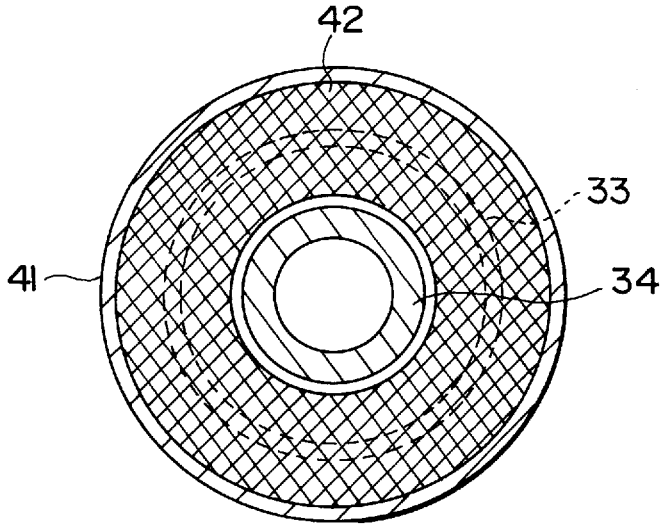
FIG. 22A is a schematic cross sectional view showing a system for decontaminating a radioactivity of a metallic waste according to a fourteenth embodiment.
Figure 22B:
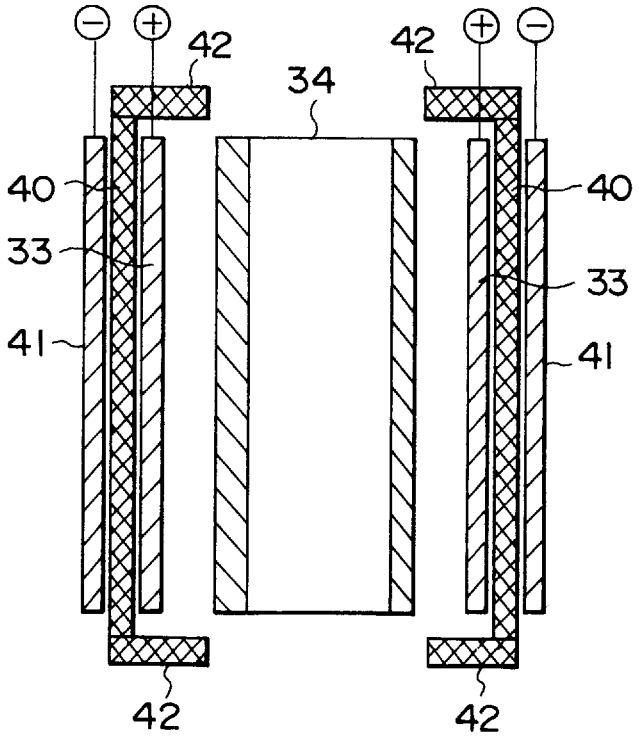
FIG. 22B is a schematic longitudinally sectional view showing the system shown in FIG. 22A.

Next, there is described a decontamination system for a radioactive metallic waste according to a fourteenth embodiment with reference to FIGS. 22A and 22B.

FIG. 22A is a plan view showing a condition in which an insulating discs 42 each having openings are attached at upper and lower portions of the cylindrical insulating shield body 40, and FIG. 22B is a longitudinal section view showing the above condition. A cylindrical anode 33 is arranged on the inner wall of the cylindrical insulating shield body 40, and a cylindrical cathode 41 is arranged on the outer wall of the cylindrical insulating shield body 40. The cylindrical metal 34 is set in the cylindrical anode 33, and a DC power source 37 is connected to the cylindrical anode 33 and the cylindrical cathode 41, respectively.

Under the condition, when a voltage having a predetermined current density is supplied from the DC power source 37 to a portion between the cylindrical anode 33 and the cylindrical cathode 41, the reaction explained by a theory of the equations (1'), (2'), (6) and (3',) occurs to charge in a positive polarity with the inner surface of the cylindrical metal 34, thereby dissolving the base metal arranged on the inner surface.

Figure 23:
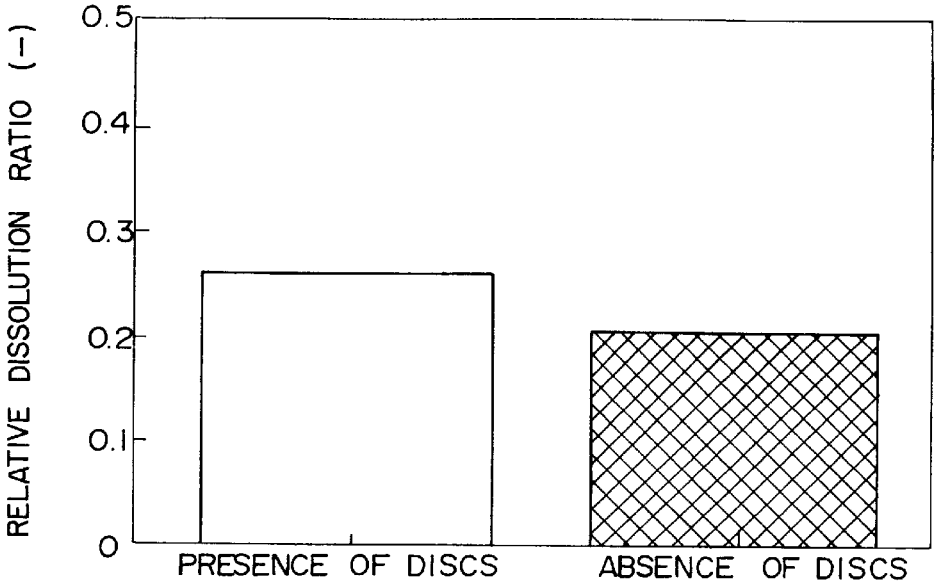
FIG. 23 is a bar graph showing a dissolution ratio under the comparison of a presence and absence of a disc in a system for decontaminating a radioactivity of a metallic waste according to a fifteenth embodiment of the present invention.

Next, there is described a decontamination system according to fifteenth embodiment of the present invention in reference with FIG. 23 showing each dissolution ratio (experiment/theory values) of results of dissolution the inner surface of the cylindrical metal 34 of the stainless steel according to the tenth and fourteenth embodiments, in which the tenth embodiment uses the cylindrical insulating shield body 40 and the fourteenth embodiment uses the shield body 40 and the insulating discs 42 each attached to the upper and lower ends of the body 40 and having opening.

In the fifteenth embodiment, phosphoric acid is selected as the electrolyte 32, and the electrolysis is performed under the condition that the density of phosphoric acid is 40%, the temperature is 60° C., the current density is 0.6 A/cm$^2$, thereby supplying the DC voltage to a portion between the cylindrical anode 33 and the cylindrical cathode 41 which is titanium coated by platinum.

As understood from FIG. 23, the relative dissolution ratio improves about 1.3 times by attaching the insulating discs 42 to the upper and lower ends of the cylindrical insulating shield body 40, respectively. There is a reason that the current leaking into a portion between the anode 33 and the cathode 41 is broken and the electrolysis is suppressed between the anode and cathode by means of an attachment of the insulating discs 42 respective to the upper and lower ends of the cylindrical insulating shield body 40.

As described above, since the insulating discs 42 are attached at the upper and lower ends of the cylindrical insulating shield body 40, respectively, it is possible to decontaminate in a short time a radioactivity of the cylindrical metal 34 and to decrease the radioactive level of the metal.

There is described a decontamination system according to a sixteenth embodiment with reference to FIG.

Figure 24:
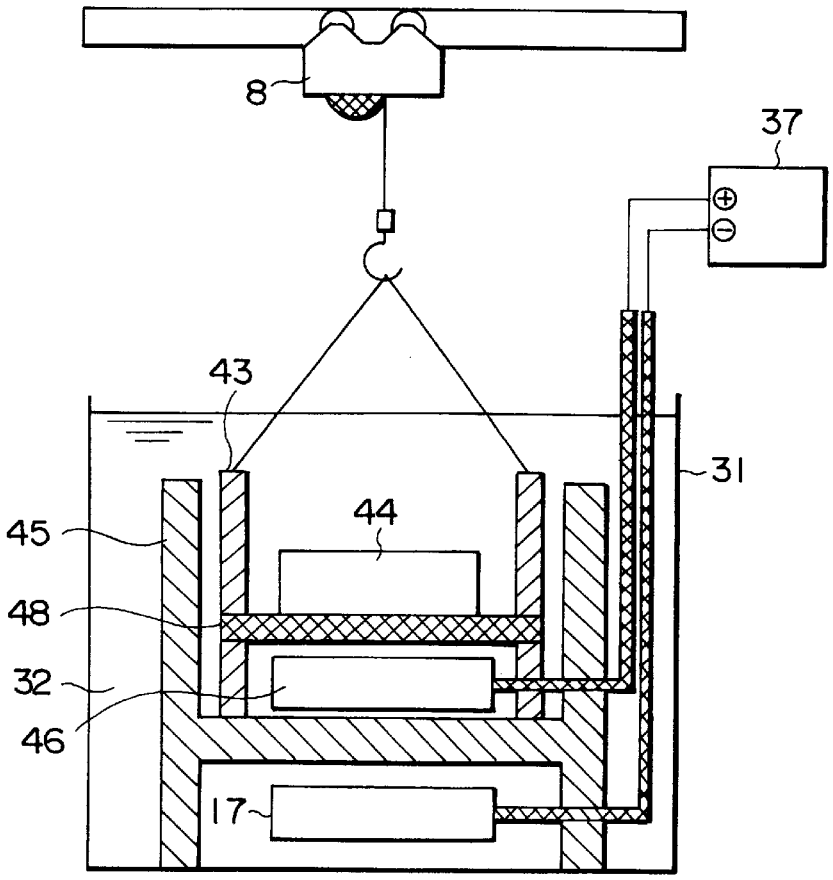
FIG. 24 is a system diagram schematically showing a system for decontaminating a radioactivity of a metallic waste according to a sixteenth embodiment of the present invention.

FIG. 24 is a longitudinal section view of the electrolysis bath 31 in the system according to the sixteenth embodiment, in which numeral 43 denotes a supporting vessel having an opening at its upper portion, and the supporting vessel 43 is hung down in the electrolysis bath 31 by a handling mechanism 38 which is set to the upper portion of the bath 31.

The supporting vessel 43 has a side surface formed of an insulating material and having a plurality of holes in a mesh-shaped for the electrolyte flowing through and a bottom portion formed of a metal material 48, and stores a plate-shaped metal 44 as the radioactive metallic waste therein.

The supporting vessel 43 is set in the insulating shield vessel 45 having an opening at its upper portion, the plate-shaped anode 46 is set to the bottom portion of the shield vessel 45, and the plate-shaped cathode 47 is set to the bottom portion of the electrolysis bath 31 through the bottom portion of the shield vessel 45.

Under the condition, when the DC voltage is supplied between the plate-shaped anode 46 and the plate-shaped cathode 47, since the potential difference occurs at both sides of the insulating shield vessel 45, the difference causes a surface of the metal material 48 provided at the bottom portion of the supporting vessel 43 facing to the plate-shaped anode 46 to be charged to the negative polarity. On the other hand, since the metal 44 contacts with the metal material 48 at the bottom portion of the supporting vessel 43, the polarity of the metal 44 is divided to charge in a positive polarity with the upper surface of the metal 44, thereby dissolving the base metal of the metal 44.

Figure 25A:
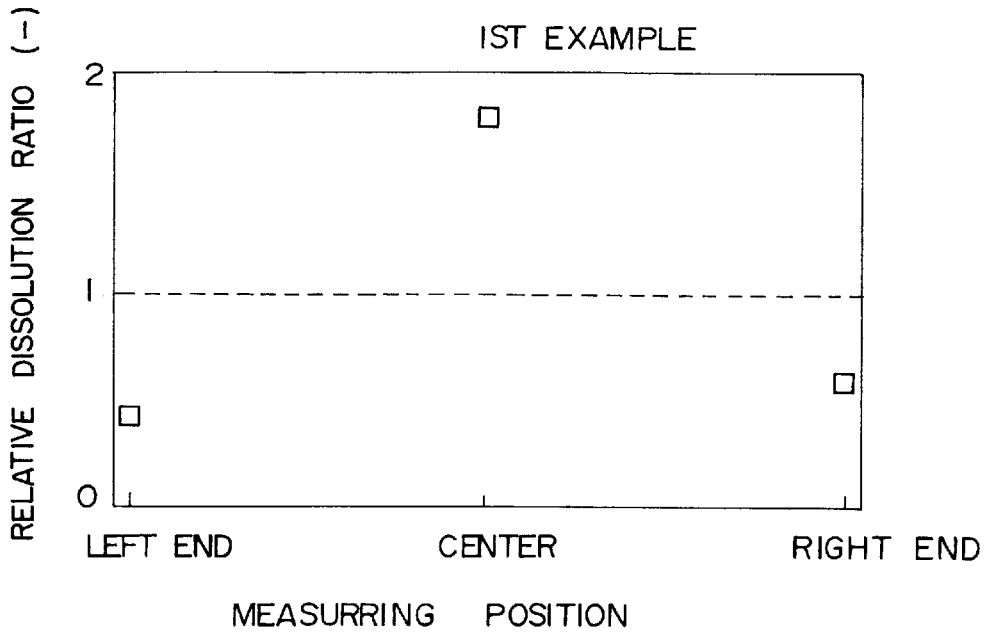
FIG. 25A is a solubility distribution characteristic diagram for explaining a first embodiment in a seventeenth embodiment of the present invention.
Figure 25B:
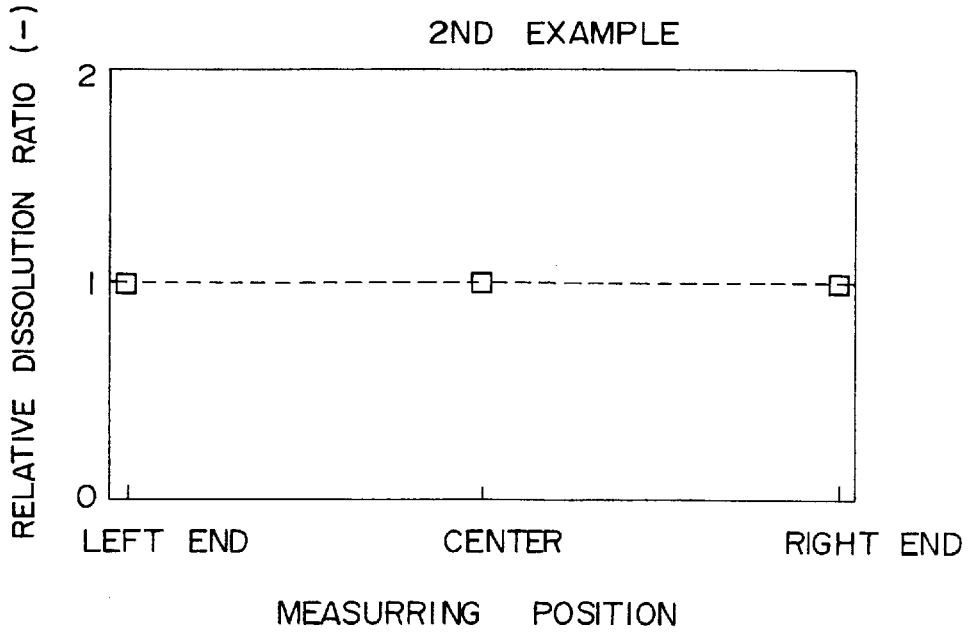
FIG. 25B is a solubility distribution characteristic diagram for explaining a second example of the seventeenth embodiment of the present invention.

Next, there is described a contamination system according to a seventeenth embodiment with reference to FIGS. 25A and 25B. FIG. 25A shows a relative dissolution distribution of the plate-shaped stainless steel of a second example when the bottom portion is formed of a passive metal of titanium coated by platinum by a relative dissolution ratio (dissolution ratio at each position against a mean dissolution ratio), and FIG. 25A shows a dissolution distribution of the plate-shaped stainless steel of a first example when the bottom portion is formed of the insulating material having a plurality of holes in a mesh-shaped for passing the electrolysis therethrough by a relative dissolution ratio (dissolution ratio at each position against a mean dissolution ratio).

In the seventeenth embodiment, phosphoric acid is selected as the an acid electrolyte and an electrolysis is performed by supplying a DC voltage between the anode and cathode formed of titanium coated by platinum under the condition that a density of phosphoric acid is 40%, a temperature of the electrolyte is a room temperature, and a current density is 0.6 A/cm$^2$.

As understood from FIG. 25B, the surface of the stainless steel can be uniformly dissolved by constructing the bottom of the supporting vessel by a metal material. However, as understand from FIG. 25A, the end is hard to be dissolved when the bottom of the supporting vessel is made of the insulating material having the plurality of holes in the mesh-shaped.

The reason is, even though it has been necessary to supply the potential larger than the equilibrium potential of the metal dissolution reaction to the surface of the metal when the metal is dissolved by a bipolar electrolytic with non-contact, that the potential at the end portion is low and the potential at the center of the metal surface is high by an influence of the leaking current between the anode and cathode.

As described above, when the bottom of the supporting vessel 43 is made of the metal material 48, since the metal surface can be uniformly dissolved, it is possible to uniformly decontaminate a metallic waste having a curved shape, a chip after cutting the metallic waste, and sundries such as tools, thereby removing a radioactivity and reducing a radioactive level of the metallic waste.

Furthermore, since the use of the supporting vessel having an insulation and an opening at its upper portion can increase a decontamination amount of the metallic waste per one batch, and can be inserted into and taken out of the electrolysis bath by using the driving mechanism, it is possible to easily utilize an automation for a mass processing.

In several embodiments mentioned above, even though phosphoric acid is used as the electrolyte, sulfuric acid, nitric acid, sodium sulfate and sodium nitrate can result the same effect.

Furthermore, in a decontamination system and method according to the present invention, since the electrolysis occurs at the wall surface of the electrolysis bath by a dielectric function when the material of the electrolysis bath is a metal, it is impossible to efficiently charge the surface of the metallic waste to a positive or negative polarity.

Accordingly, the system of the present invention uses an insulating material simple body having a drug resistance and heat resistance such as fluorocarbon, polymers and FRP, or a metal lined by an insulating material for manufacturing the electrolysis bath, the insulating shield body and insulating discs for the cylindrical metallic waste, and the insulating shield vessel for the plate-shaped metallic waste.

Even though the openings of the insulating discs may have holes for allowing the cylindrical metal for an insertion, since the insertion is done through the upper disc, the lower disc is fixed and various types of the upper discs may be attached in the manner of matching a diameter of the opening with the outer diameter of the cylindrical metal.

The electrode can be made of copper lined by titanium, further coated by platinum, a simple platinum, a metal without titanium coated by platinum, and lead compound in addition to titanium coated by platinum utilized in the above-mentioned embodiments.

Furthermore, the supporting vessel for storing the metallic waste may be made of the above-mentioned electrode material, and may be lined its side surface by the insulating material having a drug resistance and heat resistance such as fluorocarbon polymers and fiber reinforced plastics (FRP).

Figure 26:
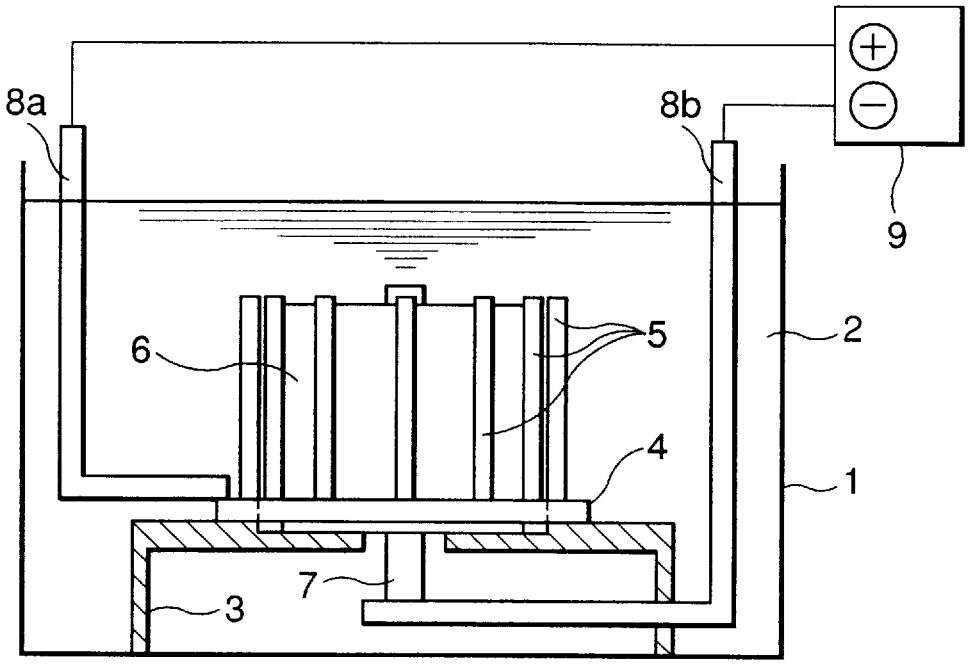
FIG. 26 is a front sectional view showing a schematical configuration of a decontamination system of a radioactivity metallic waste according to an eighteenth embodiment of the present invention.
Figure 27:
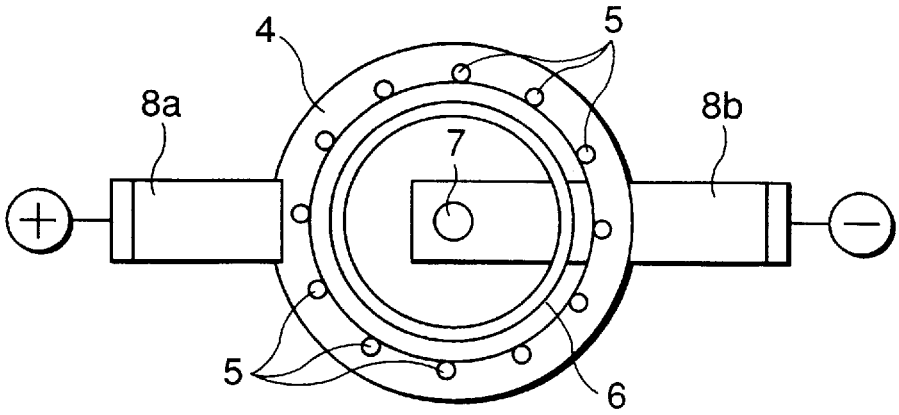
FIG. 27 is a cross sectional view showing an arrangement of electrodes in the decontamination system according to the eighteenth embodiment of this invention.

There will be described in detail a system for decontaminating a radioactivity metallic waste according to an eighteenth embodiment of the present invention with reference to FIGS. 26 and 27. FIG. 26 is a longitudinally sectional view showing a construction of the decontamination system according to the eighteenth embodiment of the present invention, in which a cathode and an anode are shown as a front view in an electrolytic bath shown as the sectional view. FIG. 27 is a cross sectional view showing an arrangement of electrodes provided in the electrolytic bath for explaining the decontamination system according to the eighteenth embodiment of the present invention. In FIG. 26, numeral 1 denotes an electrolysis bath including electrolyte 2. A platform 3 is arranged in the electrolysis bath 1, and a doughnut-shaped electrode 4 is fixed on the platform 3. Bar-shaped anodes 5 are planted and fixed to the doughnut-shaped electrode 4 by positioning them with even intervals. The doughnut-shaped electrode 4 is connected with a feeding member 8*a* of L-shaped body extending from an upper opening of the electrolysis bath so as to supply a direct current therethrough from a direct current (DC) power source 9. The doughnut-shaped electrode 4 and a plurality of the bar-shaped anodes 5 form a comb-shaped cylindrical electrode.

A cylindrical metallic waste 6 is arranged inside the anodes 5 arranged along a circle, and the bar-shaped cathode 7 is arranged inside the cylindrical metallic waste 6. The bar-shaped cathode 7 is connected with the feeder member 8*b* extending from the upper opening of the electrolysis bath in the L-shaped form, and the cathode 7 is supported so as to project from the center of the platform 3 supporting the feeder member 8*b* to the upper direction. Supply of the direct current to the anode and cathode 5 and 7 is performed by the DC power source 9 connected with the feed member 8*a* of the doughnut-electrode 4 and the feed member 8*b* connected with the doughnut-electrode 4.

With the above construction, when a predetermined DC voltage is supplied between the bar-shaped cathode 7 at the center of the bath 1 and the plurality of bar-shaped anodes encircling the waste 6 from the DC power source 9, oxygen gas is generated around the anodes 5 and hydrogen gas is generated around the cathode 7. At the same time, an outer surface of the metallic waste 6 is caused to have a negative polarity and the inner surface of the waste 6 to have a positive polarity. As a result, there occurs an electrochemical reaction as follows:

[Anode]

$$H_2O \rightarrow 2H^+ + \tfrac{1}{2}\cdot O_2 + 2e^- \quad (1)$$

[Cathode]

$$2H^+ + 2e^- \rightarrow H_2 \quad (2)$$

[Metallic waste]

$$\text{(Inner Surface) } M \rightarrow M^{n+} + ne^- \quad (3)$$

$$H_2O \rightarrow 2H^- + \tfrac{1}{2}\cdot O_2 + 2e^+ \quad (4)$$

$$\text{(Outer Surface) } 2H^+ + 2e^- \rightarrow H_2 \quad (5)$$

Thus, the radioactivity attached to the cylindrical metallic waste 6 or permeated in the base metal elutes from them and moves toward the electrolyte 2, thereby removing the radioactivity from the cylindrical metallic waste 6. When the outer surface of the cylindrical metallic waste is contaminated with the radioactivity, the outer surface of the metallic waste 6 is resolved by the inversion of the polarity of the DC power source.

The non-contact electrolysis method according to the present invention produces a larger amount of oxygen and hydrogen gas in comparison with the conventional contact electrolysis method. There has been the possibility that oxygen or hydrogen gas generated from the outer surface of the metallic waste 6 and the inner surface of the cylindrical anode stay within the anode to hinder the resolution of the base metal with the cylindrical anode of the prior art as shown in FIG. 14. On the other hand, since the present embodiment uses the bar-shaped anode, it is possible to prevent hydrogen and oxygen gas from staying in the anode area, thereby resolving the base metal with a high efficiency.

Furthermore, in the non-contact electrolysis method, in order to hang down the cylindrical metallic waste in the electrolytic bath or hang down it threrefrom using a crane or the like, it is necessary to clamp the metallic waste by the clamper. In this case, since the system according to the eighteenth embodiment invention can clamp the cylindrical metallic waste through any gaps between particular bar-shaped cathodes arranged in a circle, it is possible to improve the work efficiency during the radioactivity decontamination work. Moreover, the electrodes must be made of the anticorrosive material such as titanium (Ti), platinum (Pt), or the carbon and stainless steels with lining titanium (Ti) or lining platinum (Pt). Especially, since titanium and platinum are very expensive, it is possible to achieve a low cost in manufacturing by employing the bar-shaped anodes.

There will be described in detail a system for decontaminating the radioactivity metallic waste according to a nineteenth embodiment of the present invention with reference to FIGS. 28A and 28B which are a cross sectional view and a longitudinally sectional view respectively showing only an arrangement of anodes, cathode and cylindrical metallic waste. In the nineteenth embodiment, the system comprises a comb-shaped cylindrical electrode which is constructed by a cylindrical anode 10 having the half length of the cylindrical metallic waste 6, and a plurality of bar-shaped anodes which are evenly arranged on an end surface of the cylindrical electrode 10. A cylindrical metallic waste 6 is provided inside the cylindrical anode 10, and a bar-shaped cathode 7 is arranged inside the cylindrical metallic waste 6. In such situation, when the DC voltage is supplied between the cylindrical anode 10 and the bar-shaped cathode 7, there occurs the reaction represented by the equations (1) to (5), as has been described in the eighteenth embodiment. The radioactivity attached to the inner surface of the cylindrical metallic waste 6 or permeated in the base metal toward the electrolyte 2, thereby removing the radioactivity from the cylindrical metallic waste 6.

Figure 29A:
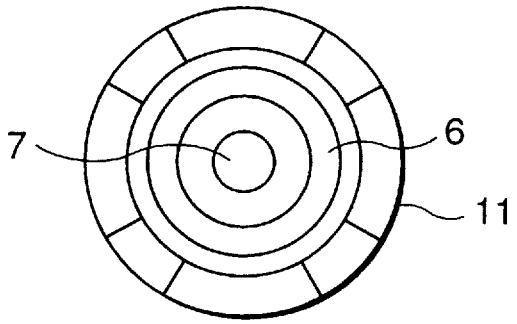
FIGS. 29A and 29B are a cross sectional view and a longitudinally sectional view respectively showing an arrangement of electrodes in a decontamination system of a radioactivity metallic waste according to a twentieth embodiment of the present invention.
Figure 29B:
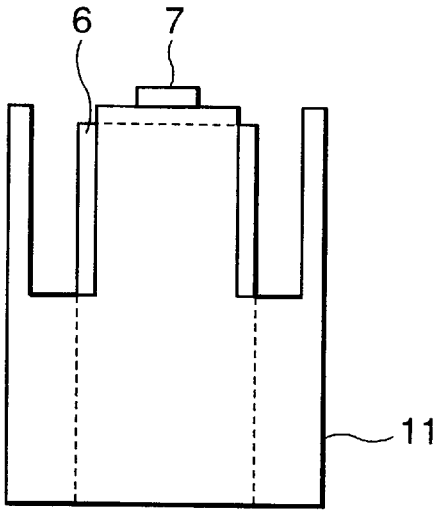

There will be described a system for decontaminating the radioactivity metallic waste according to a twentieth embodiment of the present invention with reference to FIG. 29, which are a cross sectional view and a longitudinally sectional view respectively showing only an arrangement of anodes, cathode and cylindrical metallic waste. In the twentieth embodiments, the system comprises a rectangular anode 11 having a plurality of upper projecting portions which are arranged with even distances. The cylindrical metallic waste is provided in the rectangular anode 11, and the bar-shaped cathode 7 is provided in the cylindrical metallic waste 6. The rectangular anode 11 is a comb-shaped cylindrical electrode.

With such structure, when the DC voltage is supplied between the rectangular anode 11 and the cathode 7, there occurs the reaction represented by the equations (1) to (5) in the eighteenth embodiment. The radioactivity attached to the inner surface of the cylindrical metallic waste 6 or permeated in the base metal moved toward the electrolyte, thereby eliminating the radioactivity from the cylindrical metallic waste 6.

Figure 30A:
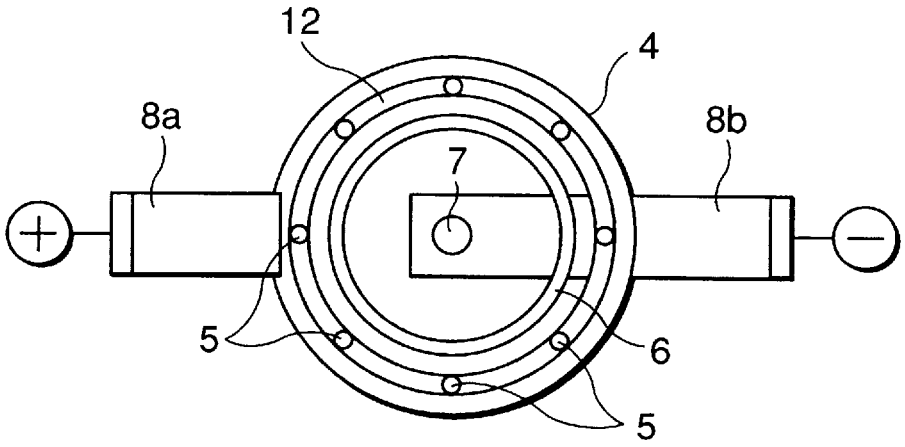
FIGS. 30A and 30B are a cross sectional view and a longitudinally sectional view respectively showing an arrangement of electrodes in a decontamination system of a radioactivity metallic waste according to a twenty-first embodiment of the present invention.
Figure 30B:
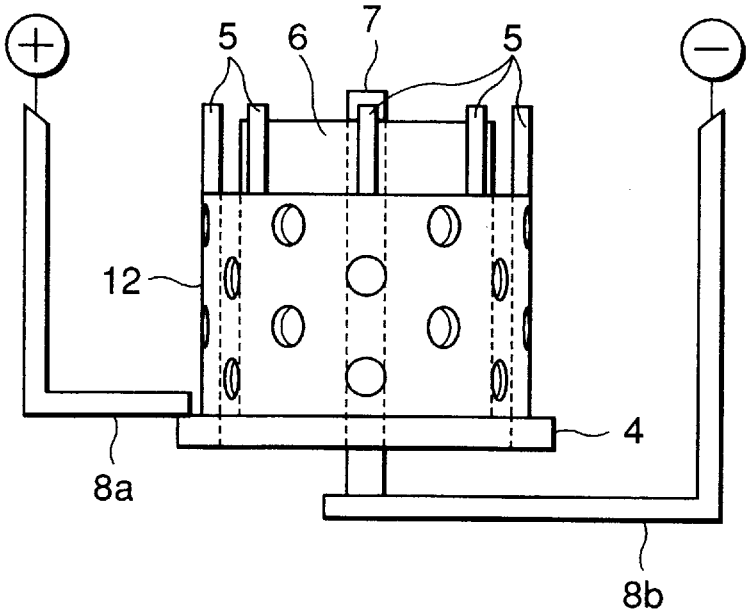

There will be described a system for decontaminating the radioactivity metallic waste according to a twenty-first embodiment of the present invention with reference to FIGS. 30A and 30B, which are a cross sectional view and a longitudinally sectional view respectively showing only an arrangement of anodes, cathode and cylindrical metallic waste. In the twenty-first embodiment, a cylindrical anode 12 has a plurality of holes on a cylindrical surface. The metallic waste 6 is provided in the cylindrical anode 12, and a bar-shaped cathode 7 is provided in the cylindrical metallic waste 6. A plurality of bar-shaped anodes 5 are planted and fixed on the upper end of the anode 12. The anode including the cylindrical anode 12 and the bar-shaped anodes 5 constitutes a comb-shaped cylindrical electrode.

With such construction, when the DC voltage is supplied between the cylindrical anode 12 and bar-shaped cathode 7, there occurs the reaction represented by the equations (1) to (5). The radioactivity attached to the inner surface of the cylindrical metallic waste 6 or permeated in the base metal moves toward the electrolyte, thereby eliminating the radioactivity from the cylindrical metal waste 6.

As described above, in the same manner as the eighteenth embodiment, the system according to nineteenth through twenty-first embodiment can eliminate the radioactivity contamination on inner and outer surfaces of the cylindrical metallic waste, and has the effect of improving the work efficiency of the decontamination and reducing a manufacturing cost by preventing hydrogen or oxygen gas from staying between the electrodes.

Figure 31A:
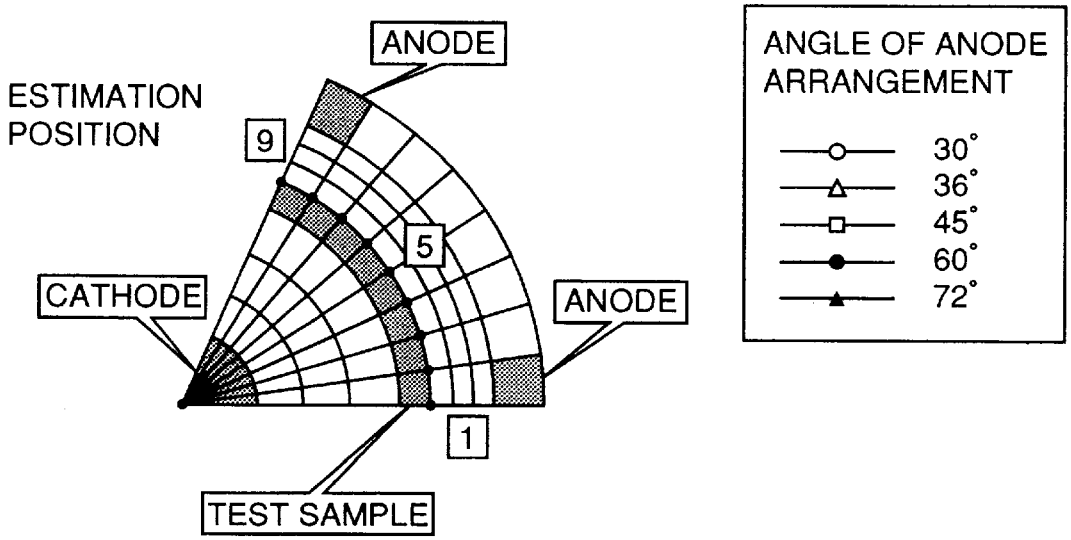
FIG. 31A is a diagram showing estimation positions of an anode and a testing object.
Figure 31B:
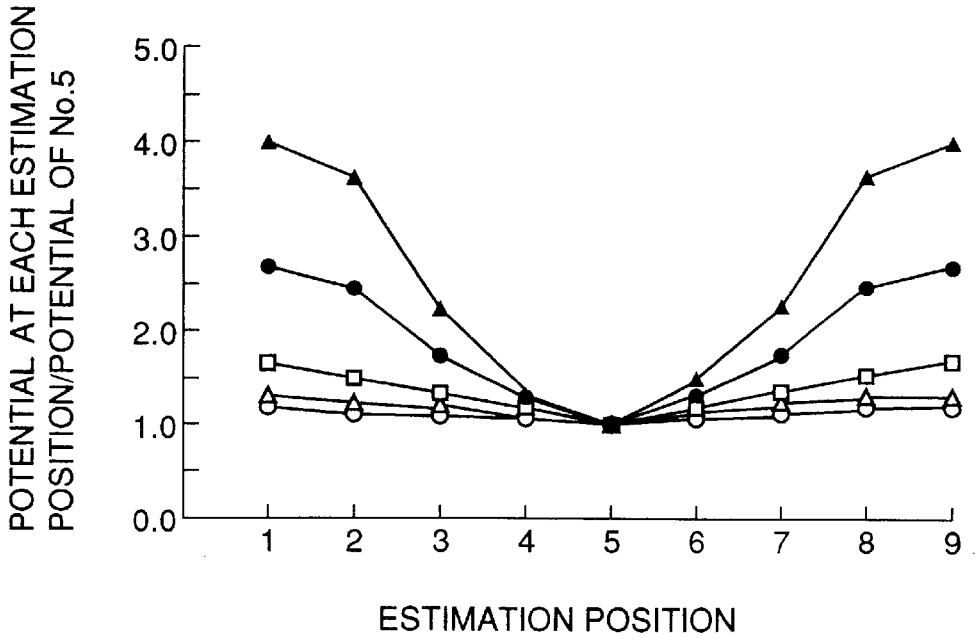
FIG. 31B is a characteristic diagram showing each potential at the estimation positions in a twenty-second embodiment of the present invention.

There will be described a system for decontaminating a radioactivity metallic waste according to a twenty-second embodiment of the present invention with reference to FIGS. 31A and 31B showing the investigated result of the arrangement of the bar-shaped anodes or projecting portions of the rectangular anode respectively shown in FIGS. 26, 27, 28A and 28B. As shown in FIG. 31A, the bar-shaped anodes are arranged at equal intervals along circumference of the cylindrical metallic waste by using as a parameter an angle thereof from the center of the cathode for measuring the distribution of potential. Referring to FIG. 31B, there is provided the distribution of the potential of the cylindrical metallic waste (a sample of the test) corresponding to a space of two bar-shaped anodes.

In the figure, the ordinate shows a ratio of a potential at each estimation position of the sample of the test and a potential of No. 5 (each position potential/No. 5 potential), and the abscissa shows the estimation positions. As understood from the result, the bar-shaped anode represents an even potential distribution by arranging at equal intervals the anodes with a small angle from the center of the bar-shaped cathode, and the surface potential increases at the testing sample facing the anode when the angle becomes broader. On the other hand, the inner surface of the cylindrical metallic waste shows an even potential distribution without depending on the arrangement of bar-shaped anodes even though the measured result is not shown in the figure. This result shows that the inner surface of the cylindrical metallic waste can be even resolved and even decontaminated without depending on the arrangement of the bar-shaped anodes.

On the other hand, an even resolution of the outer surface is influenced by the arrangement of the bar-shaped anodes. However, since the contamination of the outer surface is the adhesive contamination of an oxide membrane when the metallic waste is cut in predetermined-size portions and carried to the decontaminating position, the resolved amount of the base metal may be smaller than the contamination of the inner surface and it is little necessity to even resolve the outer surface rather than that of the inner surface. But, it is desirable that the bar-shaped anodes should be arranged at equal intervals in order to know the thickness of the resolution of the outer surface. Accordingly, at least three anodes should be arranged at regular interval of 120 degrees for the arrangement of the bar-shaped electrode. At this time, it is necessary to set a sectional area of the electrode with the consideration of a heat of the electrode due to the Joule heat.

Figure 32:
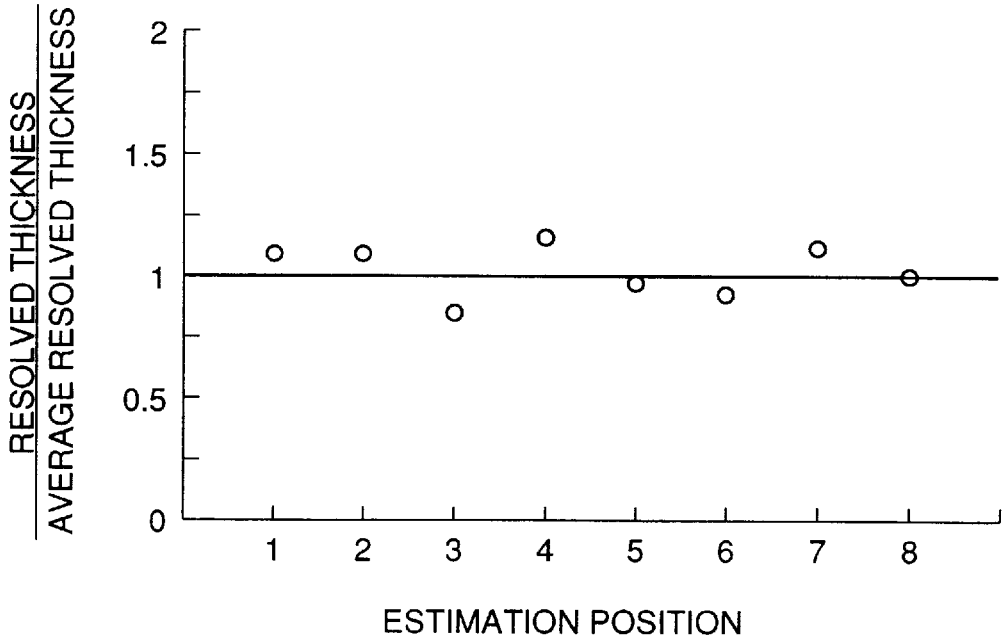
FIG. 32 is a characteristic diagram showing an effect of a decontamination system according to a twenty-second embodiment of the present invention.

There will be described a system for decontaminating a radioactivity metallic waste according to a twenty-third embodiment of the present invention with reference to FIG. 32. In the twenty-third embodiment, when six bar-shaped anodes are arranged at regular interval of 60 degrees, there is shown in FIG. 32 a distribution of the resolved thickness of the cylindrical metallic waste in the circumference direction. The test is performed under the conditions of 5 wt % of the electrolyte, 60° C. of the temperature, and 20 $A \cdot dm^{-2}$ of the current density. As understood from the result, it is possible to evenly resolve the metallic waste even though the anodes are arranged along the line.

Figure 33:
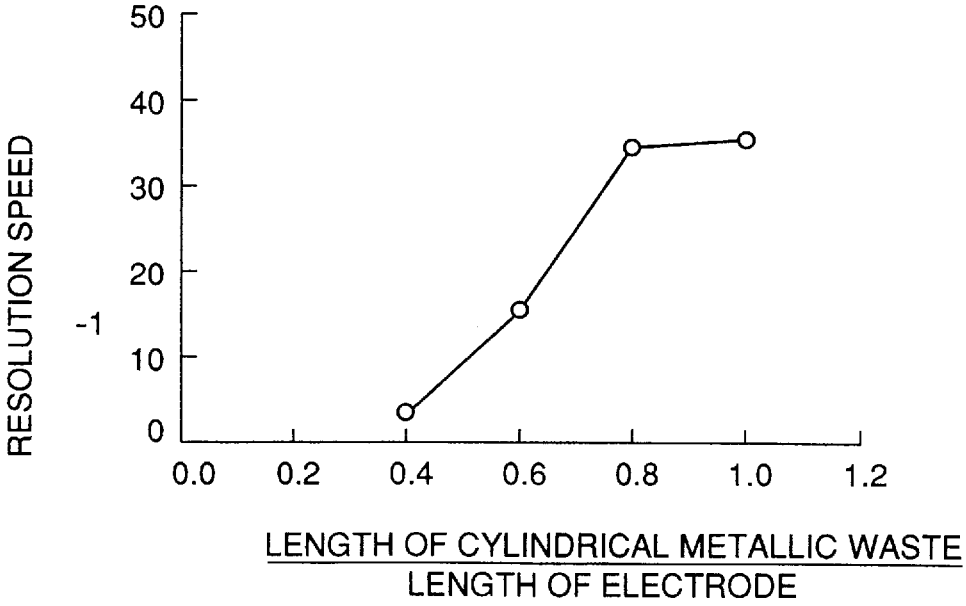
FIG. 33 is a characteristic diagram for investigating a shape of electrodes in a decontamination system according to a twenty-fourth embodiment of the present invention.

There will be described in detail a system for decontaminating the radioactivity metallic waste according to a twenty-fourth embodiment of the present invention with reference to FIG. 33. The system according to the twenty-fourth embodiment has the constitution same as that of the twenty-third embodiment, namely, six bar-shaped anodes arranged at regular interval of 60 degrees. FIG. 33 shows the resolution speed when the length of cylindrical metallic waste changes under the same condition as that of the above embodiment. As understood from the result, when the relative length of the metallic waste is shorter than the bar-shaped anodes and cathode, the resolution speed decreases because of an increase in the leak current between anodes and cathode. To solve such problem, there are provided systems according to a twenty-fifth and twenty-sixth embodiments of the present invention.

Figure 34A:
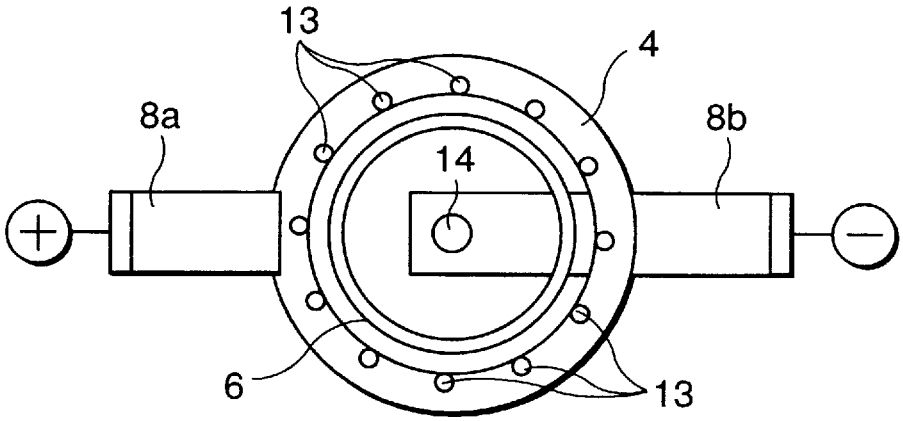
FIGS. 34A and 34B are a cross sectional view and a longitudinally sectional view respectively showing an arrangement of electrodes in a decontamination system according to a twenty-fifth embodiment of the present invention.
Figure 34B:
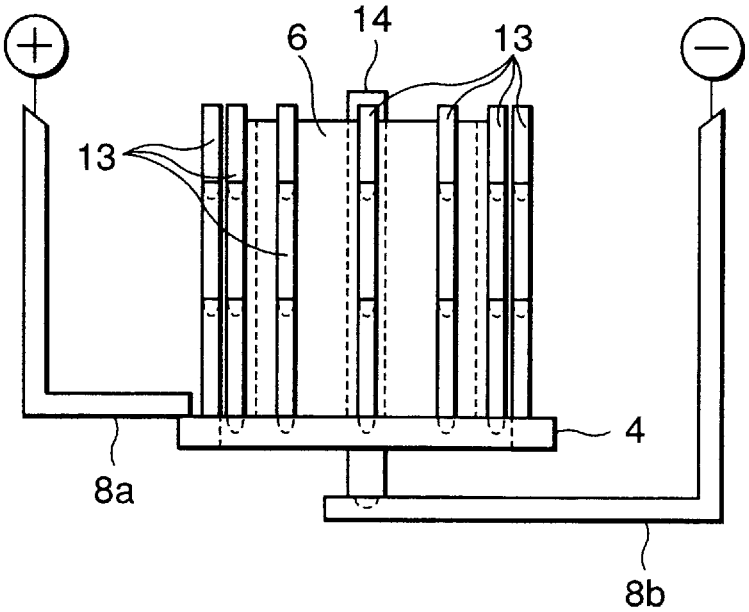
Figure 35:
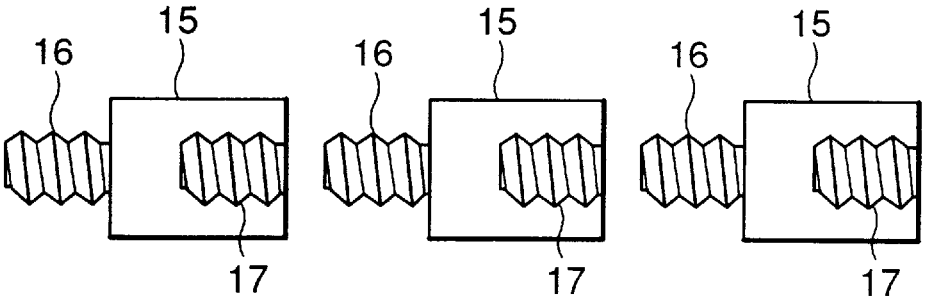
FIG. 35 is a model view showing of a pole-shaped electrode in a decontamination system according to a twenty-eighth embodiment of the present invention.

The system for decontaminating the radioactivity metallic waste according to the twenty-fifth embodiment is shown in FIGS. 34A, 34B and 35. FIGS. 34A and 34B are a cross sectional view and a longitudinally sectional view respectively showing only an arrangement of anodes, cathode and cylindrical metallic waste. In the twenty-fifth embodiment, the bar-shaped anodes are arranged at equal intervals outside the cylindrical metallic waste 6, and the bar-shaped cathode 14 is arranged inside the cylindrical metallic waste 6.

As shown in FIG. 35, the bar-shaped anode 13 and the bar-shaped cathode 14 are divided to have a predetermined length so as to form divided electrodes 15 having an external thread 16 at one end and an internal thread 17 at the other end. Several divided electrodes 15 are connected with one another to form the bar-shaped anode 13 or cathode 14. In this way, since the division of the anode 13 or cathode 14 can change the length of the bar-shaped anode 13 or cathode 14 corresponding to the length of the cylindrical metallic waste 6, it is possible to resolve the base metal with a high efficiency.

Figure 28A:
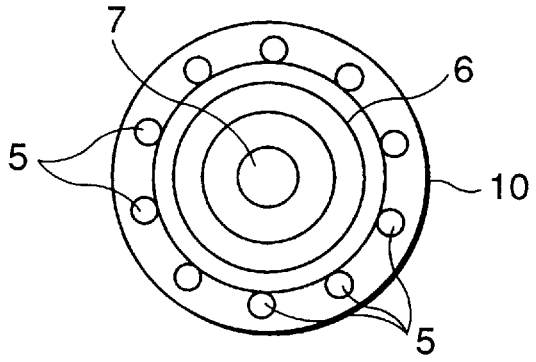
FIGS. 28A and 28B are a cross sectional view and a longitudinally sectional view respectively showing an arrangement of a decontamination system of a radioactivity metallic waste according to a nineteenth embodiment of the present invention.
Figure 28B:
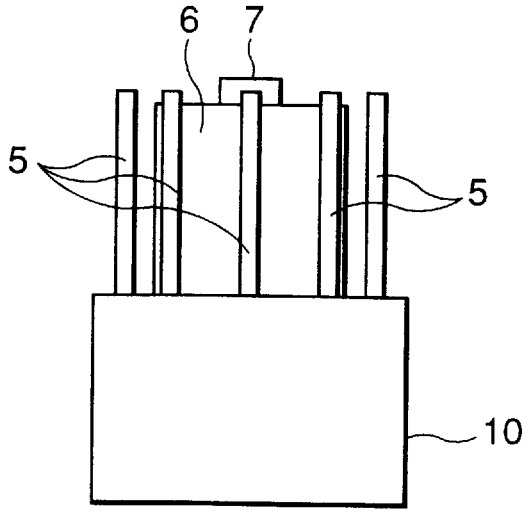

This construction can be applied to the system for decontaminating the radioactivity as shown in FIGS. 28A and 28B, in which the bar-shaped anodes 5 are arranged on the end surface of the cylindrical anode 10.

Figure 36:
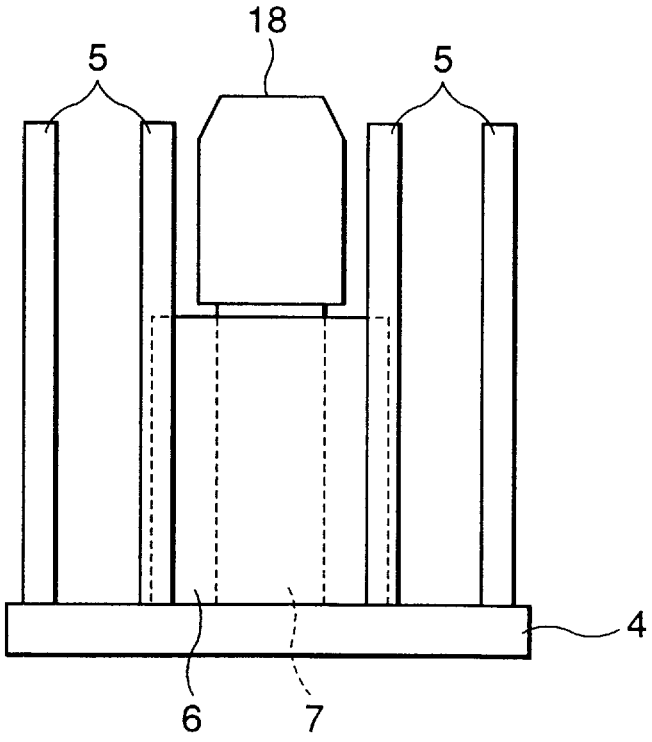
FIG. 36 is a front view showing an arrangement of electrodes in a decontamination system according to a twenty-sixth embodiment of the present invention.

There will be described in detail a system for decontaminating a radioactivity metallic waste according to a twenty-sixth embodiment of the present invention with reference to FIG. 36 which is a longitudinally sectional view showing only an arrangement of anodes, cathode and metallic waste. In the twenty-sixth embodiment, the bar-shaped anodes 5 are arranged at equal intervals around a metallic waste 6, and a cathode 7 is arranged in the metallic waste 6. An insulation cap 18 is put on the cathode 7. The insulation cap 18 is used by covering the projecting portion of the cathode 7 when the metallic waste 6 is shorter than the anode 5 and cathode 7.

With this construction, since it is possible to suppress the current leaking to the anode 5 and cathode 7, the inner surface of the metallic waste 6 can be resolved with the high efficiency. The insulation cap 18 can be put on only the anode 5, or both the anode 5 and cathode 7 to obtain the same effect.

Figure 37A:
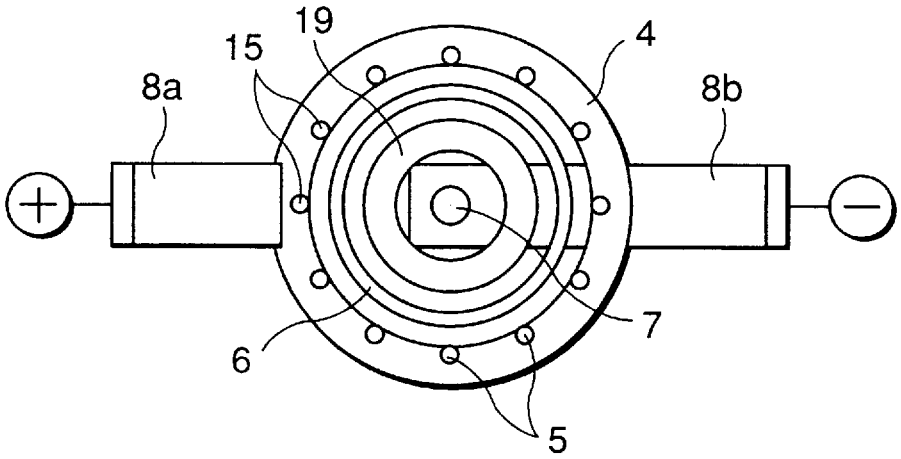
FIGS. 37A and 37B are cross sectional view and a longitudinally sectional view respectively showing an arrangement of electrodes in a decontamination system according to a twenty-seventh embodiment of the present invention.
Figure 37B:
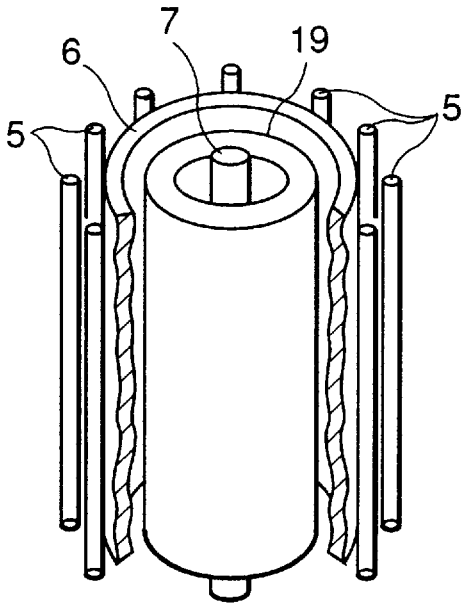

There will be described in detail a system for decontaminating a radioactivity metallic waste according to a twenty-seventh embodiment of the present invention with reference to FIGS. 37A and 37B which are a cross sectional view and a longitudinally sectional view respectively showing only an arrangement of anodes, cathode and metallic waste. In the figure, the cylindrical metallic waste 6 is arranged around the bar-shaped cathode 7, a cylindrical metal 19 is arranged around the metallic waste 6, and bar-shaped anodes 5 are arranged at equal intervals around the cylindrical metal 19.

With the above construction, when the DC voltage is supplied between the bar-shaped cathode 7 and anodes 5, there occurs the reaction shown by the equations (1) to (5) explained in the eighteenth embodiment around the cathode 7, anodes 5 and cylindrical metallic waste 6. Furthermore, the reaction causes the inner and outer surfaces of the cylindrical metal 19 to have the respective polarity in the cylindrical metallic waste 6. An arrangement of the cylindrical metal 19 in the metallic waste 6 changes a part of the potential increase path from the cathode to anode by replacing the part of the path to metal having the higher electric conductivity. With this construction, the increased potential of the cylindrical metal is added to the over-voltage on the surface of the cylindrical metallic waste as the resolving object, thereby improving the resolving performance of the base metal by increasing the amount of the current flowing on the surface.

Figure 38A:
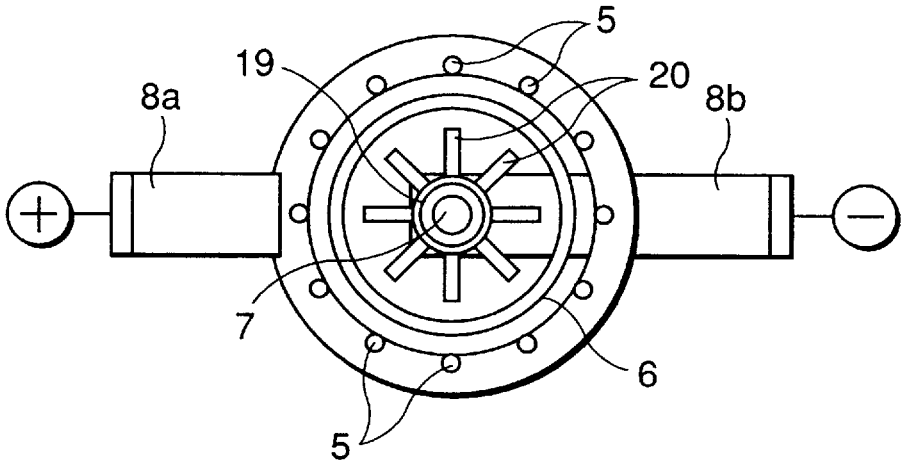
FIGS. 38A and 38B are cross sectional view and a longitudinally sectional view respectively showing an arrangement of electrodes in a decontamination system according to a twenty-eighth embodiment of the present invention.
Figure 38B:
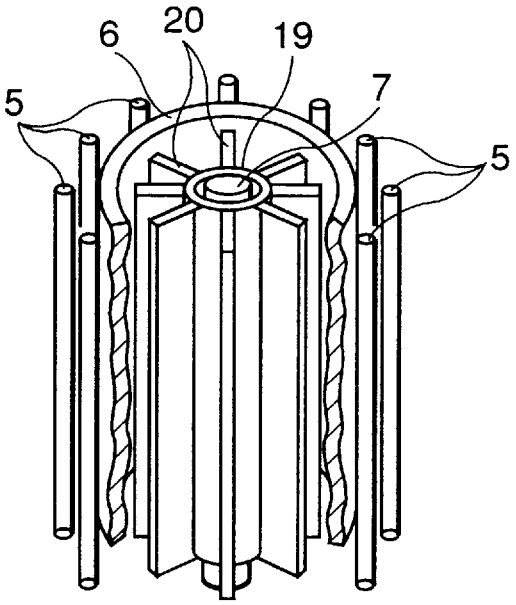

There will be described in detail a system for decontaminating a radioactivity metallic waste according to a twenty-eighth embodiment of the present invention with reference to FIGS. 38A and 38B, which are detailed figures for explaining a set arrangement of the electrodes and the cylindrical metallic waste in the twenty-eighth embodiment. FIGS. 38A and 38B are across sectional view and a perspective view respectively showing the arrangement. A cylindrical metallic waste 6 is arranged around a bar-shaped cathode 7, a cylindrical metal 19 is arranged around the cylindrical metallic waste 6, and bar-shaped anodes are arranged at equal intervals around the cylindrical metal 19 having a plurality of metal plates 20 radially attached around the outer surface of the metal 19.

In the same manner as the twenty-seventh embodiment, the arrangement of the cylindrical metal 19 having the radially attached metal plates 20 in the cylindrical metallic waste 6 changes the potential increase path by replacing a part of the path into metal having the high conductivity, so that the increased potential is added to the over-voltage on the surface of the metallic waste 6 as the resolving object, thereby improving the resolution of the base metal by increasing the amount of the current flowing on the surface.

There will be described in detail a system for decontaminating a radioactivity metallic waste according to a twenty-ninth embodiment of the present invention. In the twenty-ninth embodiment, there is described the results of test for confirming the effects of the twenty-seventh and twenty-eighth embodiments. A testing device performs a resolving test of the cylindrical metallic waste under the conditions of 5 wt % of sulfuric acid as the electrolyte, 60° C. of the temperature, and $A \cdot m^{-2}$ of the current density. As a result, when the cylindrical metal is arranged in the cylindrical metallic waste as the twenty-seventh embodiment, the resolving speed increases by 5% greater than the case using no cylindrical metal.

When the metal plates are radially attached to the outer surface of the cylindrical metal in the manner as the twenty-eighth embodiment, the resolving speed increases by 15%. Further, it is possible to obtain the same effect by enlarging the thickness of the cylindrical metal in the place of the metal plates radially attached to the cylindrical metal.

Thus, it is possible to eliminate the radioactive decontamination from the metallic waste because the resolving speed of the base metal increases when the cylindrical metal is arranged in the cylindrical metallic waste. It is desirable to apply as material of the cylindrical metal, anti-corrosive material such as titanium (Ti) and platinum (Pt), or carbon and stainless steel and copper having a lining of titanium and platinum.

Further, the cylindrical metal can be replaced by the metallic waste, namely, a cylindrical metallic waste having a small diameter can be arranged in the cylindrical metallic waste having a large diameter, thereby increasing the resolving speed of the base metal. In this case, it is possible to increase the amount of the decontamination for the radioactivity metallic waste.

Figure 39:
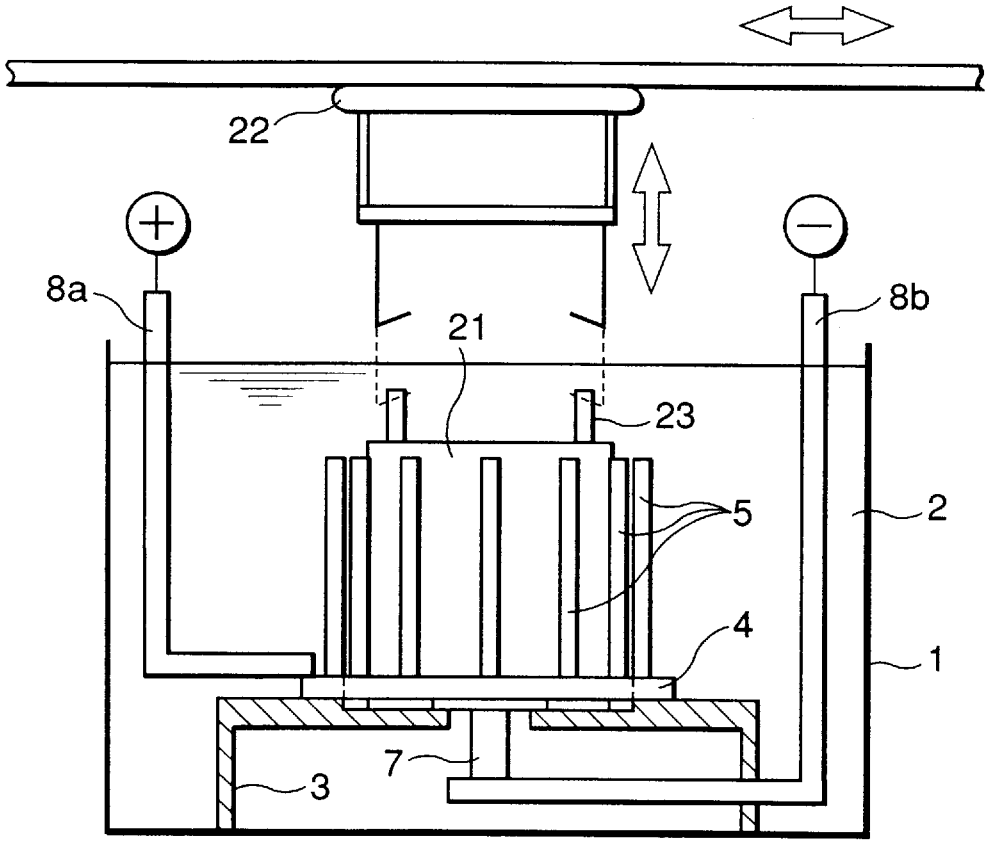
FIG. 39 is a cross sectional view showing a decontamination system of a radioactivity metallic waste according to a twenty-ninth embodiment of the present invention.

There will be described in detail a system for decontaminating a radioactivity metallic waste according to a thirtieth embodiment of the present invention with reference to FIGS. 39, 40A and 40B. FIG. 39 is a longitudinally sectional view showing an arrangement of electrodes, metallic waste and driving mechanism. In the figure, numeral 21 denotes a cylindrical supporting vessel having openings at both upper and bottom ends. A cylindrical metallic waste 6 is inserted into the vessel 21 which is carried away by a driving mechanism 22. The cylindrical supporting vessel 21 can improve the work efficiency of the decontamination. That is, it is possible to set the cylindrical metallic waste 6 in the electrolysis bath 1 or to carry easily the waste 6 to a cleaning step after the decontamination by the remote operation.

Figure 40A:
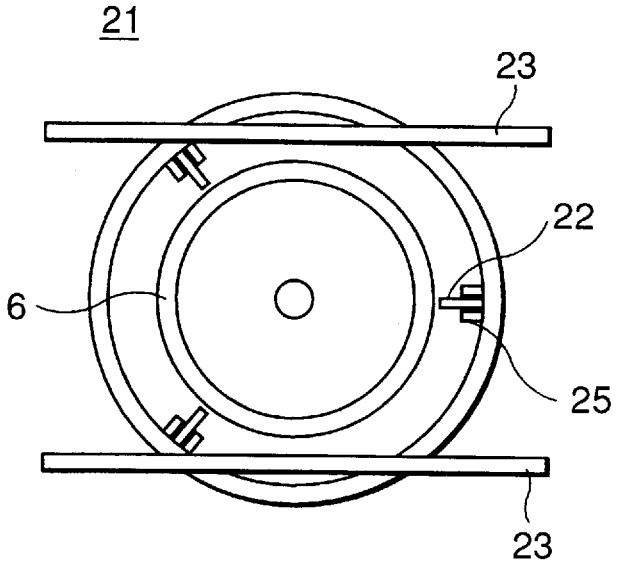
FIGS. 40A and 40B are a cross sectional view and a longitudinally sectional view respectively showing a handling vessel for a metallic waste in a decontamination system according to a twenty-ninth embodiment of the present invention.
Figure 40B:
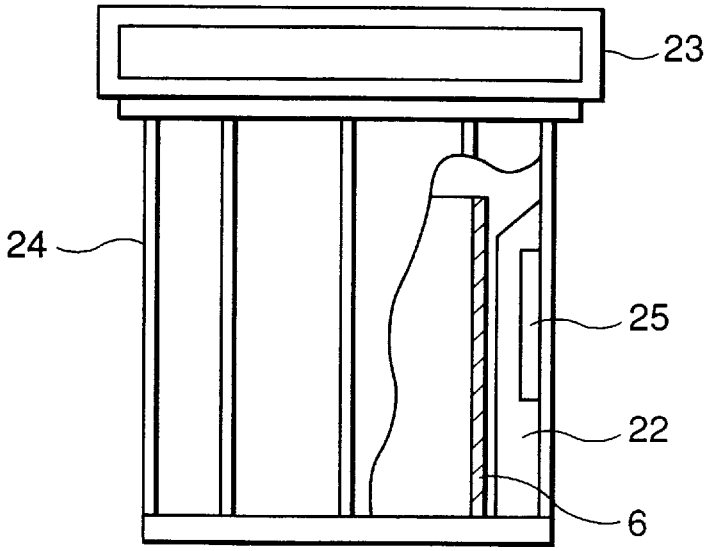

FIGS. 40A and 40B are detailed figures for the cylindrical supporting vessel 21, in which FIG. 40A is a cross sectional view and FIG. 40B is a longitudinally sectional view both showing the cylindrical supporting vessel. The supporting vessel 21 is all made of the insulation material, in which a side surface thereof is made by a longitudinal grid 24, the upper portion thereof has a lifting grip 23 and the bottom portion thereof has an opening to insert the cathode 7.

When the supporting vessel 21 is used, the cylindrical metallic waste 6 can easily be carried, thereby not only increasing the decontamination amount but also decreasing the chance of exposure of operators by the radioactivity by the remote operation.

Furthermore, fixed plates 25 each having a taper at its upper portion is provided in the cylindrical supporting vessel 21. The plates 25 are arranged at a distance of 120 degrees by inserting into the fixing grooves formed inside the longitudinal grid 24.

The cylindrical metallic waste 6 can be provided at the center of the supporting vessel by attaching the fixed plates 25. Since the fixed plates each have the taper (slant portion) at those upper portions, the cylindrical metallic waste 6 is smoothly stored in the cylindrical supporting vessel 21 without the interruption of (or caught by) the fixed plates 25. Further, since the center of the cylindrical metallic waste 6 is easy to coincide with the center of the bar-shaped cathode, it is possible to even resolve the cylindrical metallic waste 6. Since the fixed plates 25 is attached to the fixing groove 26 by the insertion, the cylindrical metallic waste 6 is usually arranged to coincide its center with that of the supporting vessel 21 by attaching the fixed plates 25 having the size corresponding to the diameter of the waste 6 even when the system decontaminates several cylindrical metallic wastes 6 having the different diameters.

As described above, since the decontamination system according to the present invention comprises any one of anode and cathode which is formed by a bar-shaped electrode arranged in a cylindrical metallic waste, and the other of the anode and cathode including a cylindrical (doughnut) base portion and a plurality of projecting portions which are projecting from the upper end surface of the cylindrical portion, the present invention has some effects as follows:

First, since the electrodes provided around the cylindrical metallic waste have a plurality of the projecting portions and gaps therebetween, gas occurring from the outer surfaces of the anode and the metallic waste is flowing through the gap between the projecting portions, thereby improving the resolution speed of the base metal. Accordingly, it is possible to eliminate the radioactive decontamination in a short time.

Second, since the projecting portions are provided at least to the upper portion of the outer electrode arranged around the cylindrical metallic waste, it is possible to improve the work efficiency of the change of the cylindrical metallic waste. Also, the decrease of the amount of anti-corrosive metal for the outer electrode results the low manufacturing cost.

Furthermore, both the inner and outer surfaces of the cylindrical metallic waste can be even resolved by an even arrangement of the bar-shaped electrodes around the cylindrical metallic waste, thereby largely improving the resolution performance.

Moreover, since the length of the electrodes can be changed by dividing the bar-shaped electrodes into a plurality of divided portions, it is possible to vary the length of the electrodes corresponding to the length of the cylindrical metallic waste, and it is possible to suppress the leak of the current between the anode and cathode.

What is claimed is:

1. A system for decontaminating radioactivity of a tubular metallic waste object through bipolar electrolysis, comprising:

an electrolysis bath for containing electrolyte;

a central electrode disposed within the electrolysis bath; and an outer electrode disposed within the electrolysis bath comprising a base and a plurality of projections that extend from the base to surround the central electrode, the central electrode and the outer electrode defining a space for a tubular metallic waste object wherein the central electrode is disposed within an inner open portion of the tubular metallic waste object and the electrodes are not contacted by the tubular metallic waste object.

2. The system according to claim 1, wherein the base of the outer electrode is ring-shaped and mounted on a supporting platform fixed to a bottom of the electrolysis bath, and wherein each of the projections extends in parallel from the base.

3. The system according to claim 1, wherein the base of the outer electrode comprises a cylindrical wall and wherein the projections are approximately equal in length to the height of the cylindrical wall.

4. The system according to claim 3, wherein the cylindrical wall defines a plurality of apertures extending there through.

5. The system according to claim 3, wherein the projections comprise longitudinally extended sections of the cylindrical wall.

6. The system according to claim 1, wherein the projections of the outer electrode are evenly distributed about the inner electrode at equal intervals of 120 degrees or less.

7. The system according to claim 1, wherein each of the projections comprises a plurality of joined sections having an external thread at a first end and a complementary internal thread at an opposite end.

8. The system according to claim 7, wherein the central electrode comprises a plurality of joined sections having an external thread at a first end and a complementary internal thread at an opposite end.

9. The system according to claim 1, wherein each of the projections further comprises an insulation cap for suppressing electrolysis at a portion of the projection covered by the cap.

10. The system according to claim 1, further comprising an insulating supporting vessel adapted to transport a tubular metallic waste object to a position in the electrolysis bath for performing electrolysis on the object, the supporting vessel having an opening at both of upper and lower portions, a longitudinal grid at a side wall, and a lifting grip for engagement by a driving mechanism.

11. The system according to claim 10, wherein the supporting vessel comprises three fixed tapered plates extending at intervals of 120 degrees toward the center of the supporting vessel for positioning a tubular metallic waste object disposed in the supporting vessel.

12. A system for decontaminating radioactivity of a tubular metallic waste object through bipolar electrolysis, comprising:

an electrolysis bath for containing electrolyte;

a central electrode disposed within the electrolysis bath;

a middle electrode in the form of a cylindrical wall disposed about the central electrode; and an outer electrode disposed within the electrolysis bath comprising a base and a plurality of projections that extend from the base to surround the central electrode and the middle electrode, the middle electrode and the outer electrode defining a space for a tubular metallic waste object wherein the middle electrode is disposed within an inner open portion of the tubular metallic waste object and the electrodes are not contacted by the tubular metallic waste object.

13. The system according to claim 12, wherein the middle electrode comprises a plurality of metal plates extending radically outward from the cylindrical wall.

* * * * *